US009550218B2

(12) United States Patent
Musante

(10) Patent No.: US 9,550,218 B2
(45) Date of Patent: Jan. 24, 2017

(54) RECEPTACLE CLEANING SYSTEMS AND METHODS FOR THE SAME

(75) Inventor: Steven A. Musante, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 1102 days.

(21) Appl. No.: 13/534,697

(22) Filed: Jun. 27, 2012

(65) Prior Publication Data

US 2014/0000654 A1 Jan. 2, 2014

(51) Int. Cl.

| | |
|---|---|
| ***B08B 9/032*** | (2006.01) |
| ***B08B 3/04*** | (2006.01) |
| ***H01R 43/00*** | (2006.01) |
| ***H01R 43/14*** | (2006.01) |
| *A46B 11/06* | (2006.01) |

(52) U.S. Cl.

CPC ..... *B08B 9/0323* (2013.01); *B08B 3/04* (2013.01); *H01R 43/002* (2013.01); *H01R 43/14* (2013.01); *A46B 11/06* (2013.01); *A46B 2200/30* (2013.01); *A46B 2200/3013* (2013.01); *B08B 2203/0229* (2013.01)

(58) Field of Classification Search

CPC ..... B08B 3/04; B08B 3/08; B08B 9/0323; B08B 9/0327; B08B 2203/0229; H01R 43/002; H01R 43/14; B05C 11/10; F15B 13/089; F15B 13/081; F15B 13/0839

USPC ..... 134/152, 166 R, 166 C, 171

See application file for complete search history.

(56) References Cited

U.S. PATENT DOCUMENTS 2,871,886 A * 2/1959 Obrebski ..... B23K 35/286 137/884
3,765,441 A * 10/1973 Chang ..... F15B 13/081 137/271
4,428,092 A 1/1984 Lipari (Continued)

OTHER PUBLICATIONS

"Hamilton Company catalog page relating to P/N 22026-02", [online]. Retrieved from the Internet: http://www.hamiltoncompany.com>, (published prior to Dec. 8, 2010), 1 pg.

(Continued)

*Primary Examiner* — Michael Barr
*Assistant Examiner* — Kevin G Lee
(74) *Attorney, Agent, or Firm* — Schwegman Lundberg & Woessner, P.A.

(57) ABSTRACT

A receptacle cleaning assembly for use with electrical connectors includes a receptacle washing fixture having a manifold body with a solution inlet and outlet. A plurality of nozzles, in communication with the solution inlet, are coupled with the manifold body and are arranged in a pattern corresponding to female connector receptacles. An interface seal is coupled with the manifold body. The plurality of nozzles extend through the interface seal, and the interface seal is configured to seal along a face of the connector. At least one solution return passage extends through the interface seal from an exterior of the plurality of nozzles to the solution outlet. An alignment skirt extends from the manifold body, and couples and aligns the connector receptacles with the plurality of nozzles. In another example, the receptacle cleaning assembly includes a receptacle brush fixture including a plurality of reciprocating brushes for use in the female connector receptacles.

22 Claims, 8 Drawing Sheets

(56) References Cited

U.S. PATENT DOCUMENTS 4,559,664 A * 12/1985 Bohme ..... B08B 3/02 134/171
4,575,892 A 3/1986 Ross
4,685,480 A * 8/1987 Eck ..... B01L 99/00 134/182
4,993,100 A 2/1991 Halboth et al.
5,341,841 A * 8/1994 Schaefer ..... F15B 13/081 137/561 A
D363,376 S 10/1995 Nieman
5,595,606 A * 1/1997 Fujikawa ..... C23C 16/45561 118/715
5,626,157 A * 5/1997 Galpin ..... B08B 15/007 134/104.1
5,711,822 A 1/1998 Burgett
6,507,970 B1 1/2003 Newlun
D477,897 S 7/2003 Bradford et al.
6,839,935 B2 * 1/2005 Kiani ..... B08B 1/00 15/210.1
7,103,254 B2 * 9/2006 Yamada ..... G02B 6/25 385/134
8,627,534 B2 * 1/2014 Van Dyke ..... B08B 1/00 134/6

OTHER PUBLICATIONS

"Mill-Rose Company catalog page—Miniature Twisted-Wire Brushes", [online]. Retrieved from the Internet: <URL: http://www.mill-rose.com>, (published prior to Dec. 8, 2010), 1 pg.

"U.S. Plastic Corp. catalog page—2.5 Gallon/10L Nalgene® Heavy Duty Vacuum Carboy", [online]. Retrieved from the Internet: <URL: http://www.usplastic.com/catalog/item.aspx?itemid=31629&catid=751>, (published prior to Dec. 8, 2010), 1 pg.

* cited by examiner

Fig. 2A
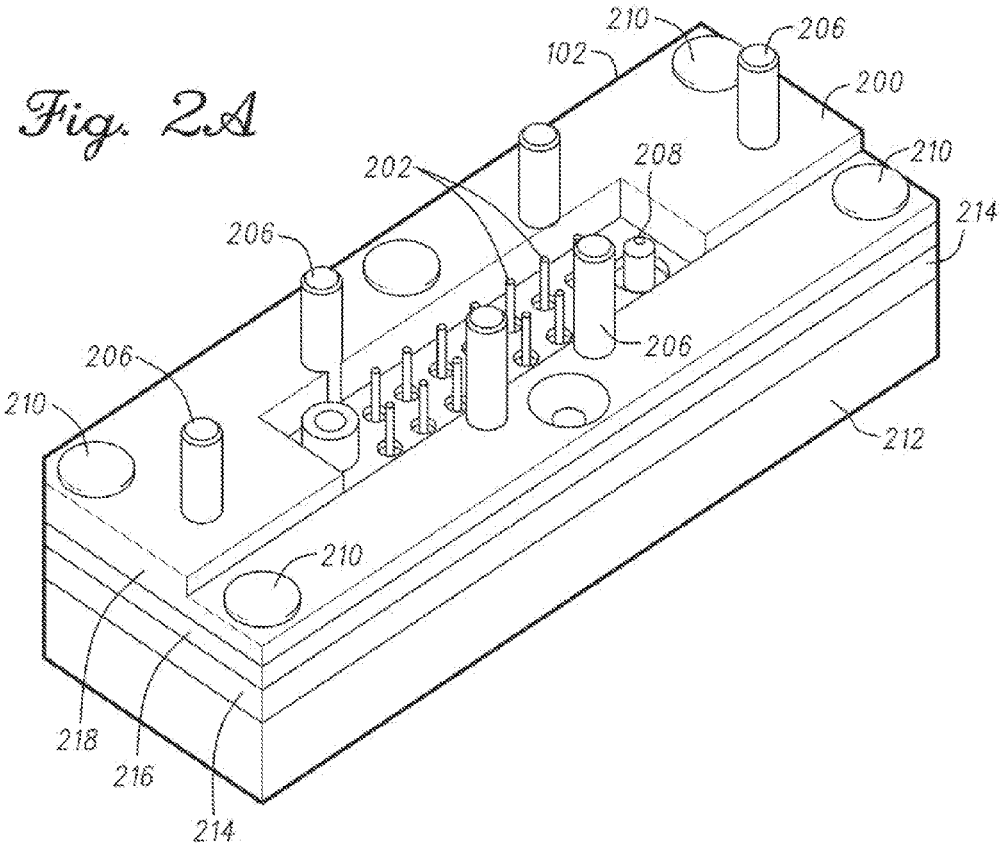
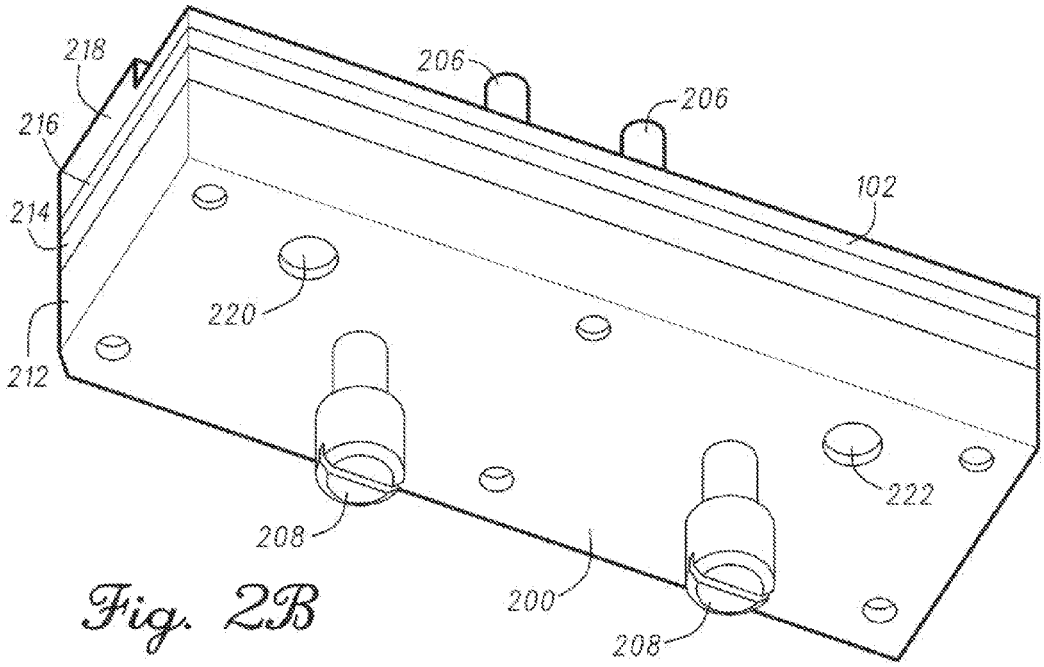
Fig. 2B

Fig. 8
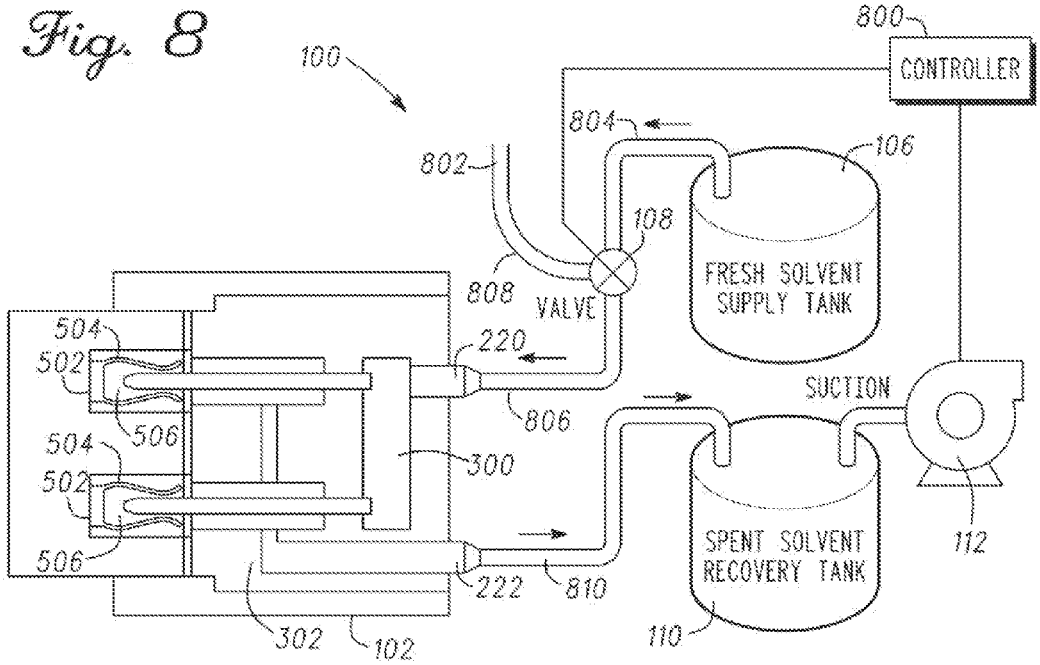
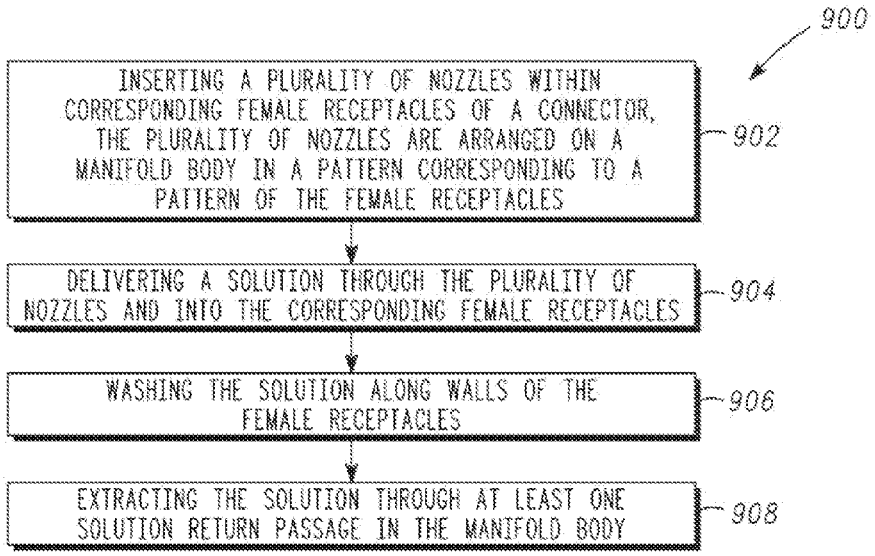
Fig. 9

RECEPTACLE CLEANING SYSTEMS AND METHODS FOR THE SAME

STATEMENT REGARDING FEDERALLY SPONSORED RESEARCH OR DEVELOPMENT

This invention was made with government support under award number W31P4Q-06-C-0466. The government has certain rights in this invention.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Raytheon Company; Waltham, Mass.; All Rights Reserved.

TECHNICAL FIELD

This document pertains generally, but not by way of limitation, to cleaning of receptacles used in electrical and data cabling.

BACKGROUND

Electrical connectors, such as connectors used to couple electrical cabling with one or more devices, in at least some examples include corresponding male and female features that provide aligned contact between elements in each of the connectors. In some examples, the male features include a plurality of pins received in a corresponding plurality of female receptacles. During one or more of assembly, use, storage, maintenance and the like the female receptacles may become fouled with debris, dirt, solder flux and the like. The female receptacles are often small, for instance with a diameter of less than 0.125 inches, have a large length relative to the diameter, and correspondingly provide a difficult to access location for cleaning.

In one example, one or more wire brushes are inserted within at least one of the female receptacles and reciprocated to dislodge debris therein. The small width brush shafts are smaller than the receptacles and are prone to bending when improperly inserted in the female receptacles.

In another example, solvents and the like are applied to the periphery of the connector. For example a cloth is wetted with a solvent and then wiped across the openings of the female receptacles. In one case, debris near the openings is swept up in the cloth. In another case, debris at the openings is instead funneled and pushed into the receptacles thereby frustrating further attempts at removal.

OVERVIEW

The present inventors have recognized, among other things, that a problem to be solved can include the buildup over time of debris on contacts of connectors, for instance within the sockets of female connectors, or residual flux and chemical contamination from the soldering of connectors to their cables. With a connector installed in a piece of equipment it is difficult to reach the connector and clean the connector without also exposing surrounding sensitive components to cleaning solutions, such as solvents. In an example, the present subject matter can provide a solution to this problem, by providing a receptacle cleaning assembly including receptacle washing fixture having a plurality of nozzles arranged in a pattern corresponding to the receptacle sockets. The plurality of nozzles provide a flow of cleaning solution into each of the receptacle sockets, for instance with a sealed engagement along the face of the connector and the fixture. Optionally, the cleaning solution is supplied with a negative pressure to substantially prevent the spraying of the solution into sensitive components surrounding the fixture and the installed connector.

With the receptacle washing fixture the installed connector does not need to be removed for cleaning. Instead, the connector is cleaned while installed. Additionally, the receptacle washing fixture provides a dedicated flow of cleaning solution and extraction of the same from each of the receptacle sockets accordingly ensuring each of the sockets are cleaned.

In another example, the receptacle cleaning assembly includes a receptacle brush fixture having a pattern of reciprocating brushes corresponding to the sockets of the female receptacle. In a similar manner to the receptacle washing fixture, the brush fixture is coupled with the connector and the plurality of brushes are aligned with the connector sockets. A plunger is operated to reciprocate the aligned brushes within each of the sockets at the same time. The plunger mechanically abraids debris, such as solder flux, and removes the debris through reciprocation. Optionally, the receptacle brush fixture is used alone or in combination with the receptacle washing fixture. In one example, the receptacle washing fixture is able to remove any debris remaining in the sockets after brushing with the cleaning solution flow.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 2A is a top isometric view of one example of a receptacle washing fixture.

FIG. 2B is a bottom isometric view of the receptacle washing fixture of FIG. 2A.

FIG. 8 is a schematic diagram showing one example of a receptacle washing fixture coupled with an installed connector.

FIG. 9 is a block diagram showing one example of a method for cleaning female receptacles of a connector.

DETAILED DESCRIPTION

Figure 1:
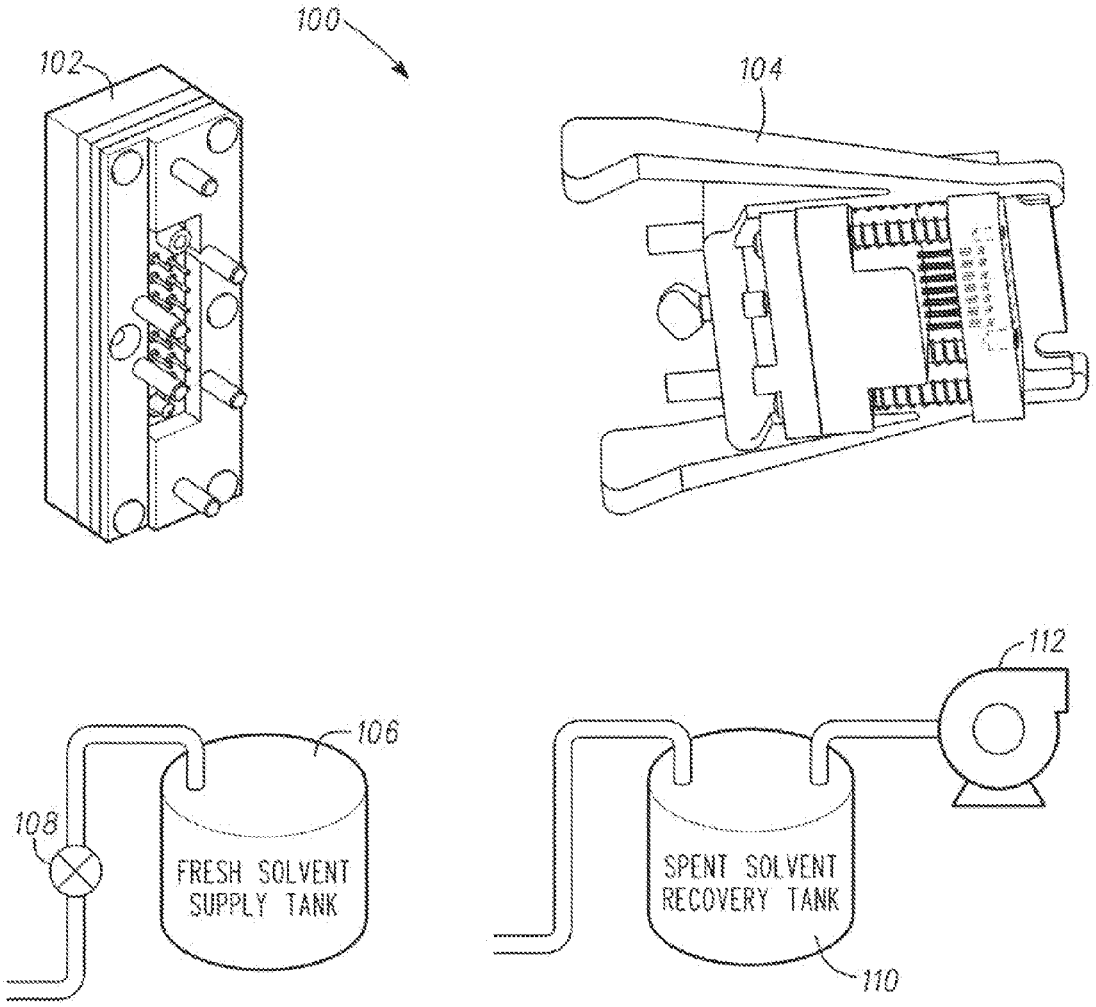
FIG. 1 is a kit showing one example of a receptacle washing fixture and a receptacle brush fixture.

FIG. 1 shows one example of a receptacle cleaning assembly 100, for instance a kit including one or more of the components shown. In one example, the receptacle cleaning assembly 100 includes a receptacle washing fixture 102 and an optional receptacle brush fixture 104. The receptacle cleaning assembly 100 further includes in another example a solution supply reservoir 106 having a flow control valve 108. The flow control valve 108 includes a two- or three-way flow valve configured to allow for selective flow of solution from the solution supply reservoir 106 for instance into the receptacle washing fixture 102. In another example, where the flow control valve 108 includes a three-way control valve, the flow control valve 108 is configured for opening into a second configuration wherein the flow valve allows for the introduction of a gas, such as air, into the passage from the valve to the receptacle washing fixture 102. The flow of gas, such as air, through the receptacle washing fixture 102 as well as a connector coupled with receptacle washing fixture 102 optionally dries the connector coupled with the receptacle washing fixture.

In yet another example, the receptacle cleaning assembly 100 further includes a solution recovery reservoir 110 sized and shaped to receive solution delivered from the solution supply reservoir 106, for instance through the receptacle washing fixture 102. As shown in FIG. 1 in one example, the solution recovery reservoir 110 is provided with a vacuum source 112. The vacuum source includes, but is not limited to, mechanical vacuum pumps, hand pumps, and the like configured to provide a negative pressure to the receptacle washing fixture 102 and thereby correspondingly draw solution or gas through the receptacle washing fixture 102, for instance from the solution supply reservoir 106 or a gas source by way of the flow control valve 108.

As will be described herein in detail, the receptacle cleaning assembly 100 including for instance the receptacle washing fixture 102 cooperates with each of the solution supply reservoir 106 and the solution recovery reservoir 110 to provide for a flow of fluid through a number of sockets of a connector coupled with the receptacle washing fixture 102. The solution includes, for instance, a solvent such as isopropyl alcohol. The solution is drawn through the receptacle washing fixture 102 and the connector coupled with the fixture by negative pressure. Negative pressure substantially prevents the spraying of the solution or solvent outside of the receptacle washing fixture 102 and thereby provides a clean and sealed system configured for reliable use within an existing system, for instance adjacent to sensitive components such as circuit boards, wiring, and other sensitive components of a surrounding device (e.g., including but not limited to a missile guidance systems, electronics, instruments, and the like).

In another example and as previously described herein, the receptacle cleaning assembly 100 includes a receptacle brush fixture 104. The receptacle brush fixture 104 is in one example used in combination with the receptacle washing fixture 102 to provide enhanced cleaning to a connector sized and shaped for connection to both of the receptacle washing fixture 102 and the receptacle brush fixture 104. As will be described herein, the receptacle brush fixture 104 provides a series of brushes in a pattern for delivery into the corresponding sockets of a connector. Additionally, the receptacle brush fixture 104 includes a plunger mechanism sized and shaped to reciprocate the brushes into and out of the sockets of the connector with substantially no lateral movement of the brushes that would otherwise cause bending, misalignment or the like between the brushes and the sockets of the connector. When used in combination with the receptacle washing fixture 102, the receptacle brush fixture 104 provides mechanical cleaning of the sockets of the connector while the receptacle washing fixture 102 provides corresponding hydrodynamic and solvent based cleaning of the connector sockets.

FIGS. 2A and 2B show opposed top and bottom views of the receptacle washing fixture 102 previously shown in FIG. 1. Referring first to FIG. 2A, the receptacle washing fixture 102 includes a manifold body 200. As shown, a plurality of nozzles 202 extend from the manifold body 200 and are configured for delivery into sockets of a connector, such as a female connector. For instance, in one example the manifold body 200 includes a connector recess 204 sized and shaped to receive at least a portion of the connector therein. As further shown in FIG. 1, in another example, the manifold body 200 provides an alignment skirt 206 sized and shaped to provide alignment features for coupling a connector with the manifold body 200. As shown, the alignment skirt 206 provides a series of features that guide the sockets of the connector onto the corresponding nozzles 202. The alignment skirt includes but is not limited to one or more pins (as shown in FIG. 2A), ridges, grooves, and the like that position a connector relative to the nozzles 202 and allow for snug engagement of the connector with the corresponding features of the manifold body 200, for instance within the connector recess 204.

In another example, the manifold body 200 includes one or more retaining features 208. In one example, the retaining features correspond to thumb screws, pins, and the like sized and shaped for corresponding reception and coupling with similar features on the connector. For instance, where the connector is provided with receptacles or thumb screws, the retaining features 208 of the receptacle washing fixture 102 are correspondingly sized and shaped to engage with these features of the connector and thereby provide a tight interface between the receptacle washing fixture 102 and the connector.

The manifold body 200 is, in one example, a laminate formed with a plurality of layers. These layers are coupled together and tightly fastened with one or more body fasteners 210 extending through the plurality of the layers. Referring to FIG. 2A, in one example the manifold body 200 is constructed with a base layer 212 and an intermediate layer 214 coupled over the base layer 212. As will be described herein, a supply manifold 200 is formed between the base layer 212 and the intermediate layer 214 to provide a source of fluid for the nozzles 202. As further shown in FIG. 2A, an interface plate 216 is coupled over the intermediate layer 214. The interface plate 216 provides the underlying substrate for connection with the face of the connector. As will be described herein, in one example a gasket or seal is provided over the interface plate 216 to provide a deformable surface on the interface plate 216 sized and shaped to tightly engage in sealing contact with the connector and thereby provide sealed passages between the nozzles 212 and the sockets of the connector. The sealed passages allow for the introduction and removal of fluid to each of the sockets of the connector.

As further shown in FIG. 2A, in one option the manifold body 200 further includes a connector shroud 218 coupled over the interface place 216. The connector shroud 218 defines at least a portion of the connector recess 204. The connector shroud 218 provides a ridge around a portion of the interface plate 216 sized and shaped to engage with the connector and substantially cover that portion of the connector interfacing with the interface plate 216. The connector shroud 218 substantially prevents mechanical damage to the nozzles and interrupts the flow of any incidental leaking fluids, gasses, or the like delivered through the nozzles 202 and into the sockets of the connector.

Referring now to FIG. 2B, the manifold body 200 is shown again from the bottom. As in the previous figure, the manifold body 200 includes an alignment skirt 206 partially shown in FIG. 2B. Further, the retaining features 208 previously described and shown in FIG. 2A are again shown in FIG. 2B. As shown in the Figure, the retaining features 208 include in this example thumb screws sized and shaped to engage the opposed ends of the features with corresponding portion of a connector (e.g., threading) coupled with the fixture 102.

Referring again to FIG. 2B, as shown the manifold body 200 further includes a solution inlet 220 and a solution outlet 222. The solution inlet 220 is in one example in fluid commination with a supply manifold, such as the supply manifold 300 shown in FIG. 3. The solution outlet 222 is correspondingly coupled with a return manifold, such as the return manifold 302 shown in FIG. 3. Optionally, the solution inlet 220 is in fluid communication with the plurality of nozzles 202 without the intervening supply manifold and the solution outlet is in fluid communication with the plurality of solution return passages described herein without the intervening return manifold.

The solution inlet and outlet 220, 222 allow for the delivery and removal of fluids through the receptacle washing fixture 102, including but not limited to, solvents, gasses, and the like. As described herein, the solution and gasses are distributed through the plurality of nozzles 202 shown in FIG. 2A to one or more sockets of a corresponding connector coupled with the receptacle washing fixture 102. The delivery of the solution or gasses through the sockets of the connector allows for the individual and rapid cleaning of the sockets with the receptacle washing fixture 102 coupled with the connector in a manner identical to the corresponding male connector coupled with the female connector. That is to say, a connector such as a connector already installed in a piece of hardware may be cleaned with a receptacle washing fixture 102 without requiring removal or replacement of the connector. Instead, solutions and gases are delivered through the solution inlet 220 and removed through the solution outlet 222 for instance by the application of negative pressure to thereby draw the fluid through the plurality of nozzles 202 shown in FIG. 2A and correspondingly clean the sockets of the connector. Removal of the connector for cleaning in a bath, pressurized cleaning and the like is not required as the connector may remain installed while being cleaned with the washing fixture 102.

Figure 3:
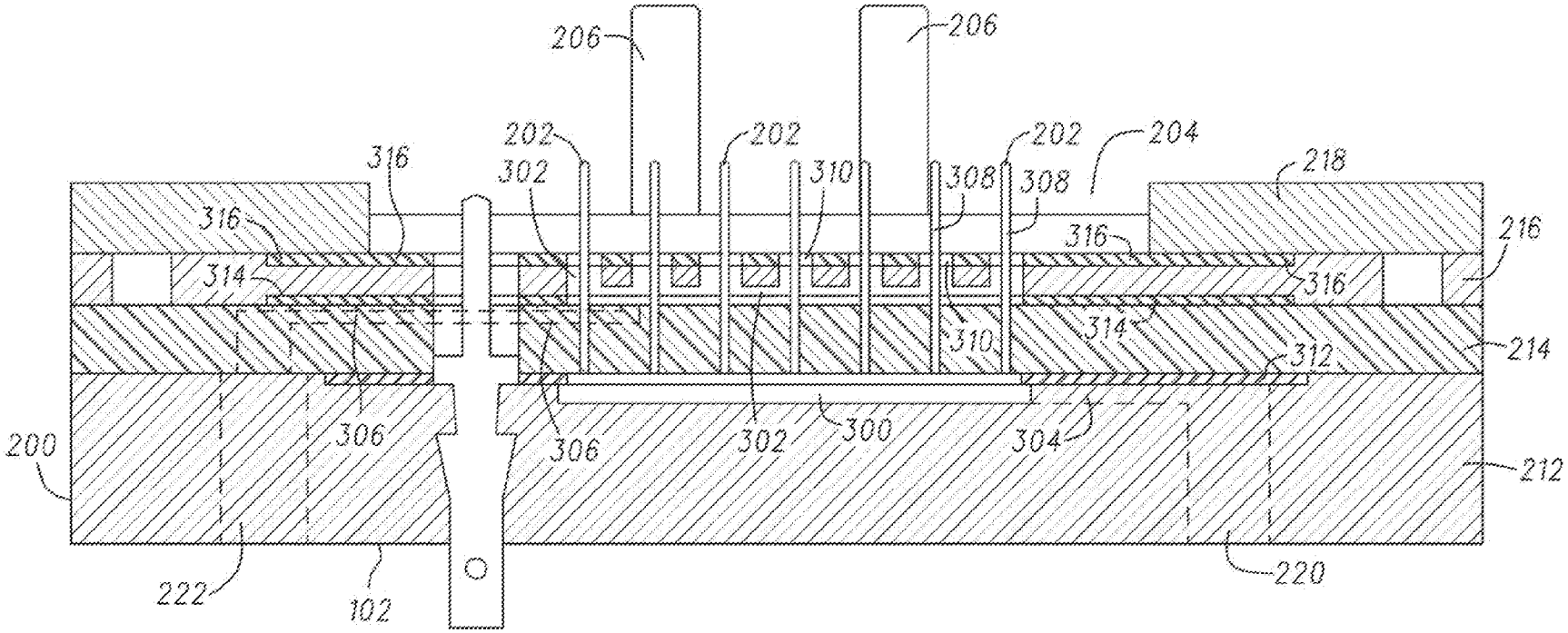
FIG. 3 is a cross sectional view of the receptacle washing fixture of FIG. 2A.

FIG. 3 shows a cross sectional view of the receptacle washing fixture 102. As previously described, the manifold body 200 includes a plurality of layers, for instance including the base layer 212, the intermediate layer 214, the interface plate 216, and the connector shroud 218. In one example, the layers 212, 214, 216 are coupled together to provide manifolds therebetween. The coupling of the base layer 212 with the intermediate layer 214 and a supply manifold gasket 312 therebetween forms a supply manifold 300. As shown, the supply manifold 300 is positioned adjacent a plurality of nozzle lumens 308 extending through each of the nozzles 202. As will be described in further detail below, the nozzle lumens 308 deliver solution from the solution inlet 220 coupled to the supply manifold 300 by way of an inlet channel 304 to thereby provide fluid to one or more sockets of a connector attached to the receptacle washing fixture 102.

Referring again to FIG. 3, the coupling of the intermediate layer 214 with the interface plate 216, for instance with a return manifold gasket 314 therebetween, correspondingly forms the return manifold 302. As shown in FIG. 3, the return manifold 302 is in communication with a plurality of solution return passages 310 extending through the interface plate 216. The nozzle lumens 308 of the plurality of nozzles 202 are in fluid communication with the solution return passages 310 (e.g., where a sealed environment is provided through engagement with a female connector) and are correspondingly in communication with the return manifold 302. With a connector coupled with the receptacle washing fixture 102, a sealed cavity is formed over each of the nozzles 202 to thereby facilitate both the delivery of fluids such as solvents, air and the like into the sockets of the connector and removal of fluids through the one or more solution return passages 310. The fluid (cleaning solvent, gas such as air and the like) drawn into the solution return passages 310 and the return manifold 302 is subsequently moved through an outlet channel 306 in fluid communication with the solution outlet 222. As shown in FIG. 3, the outlet channel 306 is in one example a portion of the intermediate layer 214. As will be described in further detail below, the solution inlet 220 and the solution outlet 222 are in one example coupled with the solution supply reservoir 106 and the solution recovery reservoir 110 previously shown in FIG. 1. The reservoirs 106, 110 correspondingly provide sources of cleaning solution (e.g., solvents including isopropyl alcohol and the like) and negative pressure for delivery or facilitating the delivery of solutions through the receptacle washing fixture 102 for cleaning of a connector coupled with the receptacle washing fixture.

As shown in FIG. 3, the supply and return manifolds 300, 302 are formed at least in part by the respective supply manifold gasket 312 and the return manifold gasket 314. Stated another way, the supply and return manifold gaskets 312, 314 are sandwiched between the corresponding base layer 212, intermediate layer 214, and the interface plate 216 to form the supply manifold and return manifold 300, 302. In another example, the supply and return manifolds 300, 302 are formed for instance by recesses in one or more of these layers. The layers are then coupled with adhesives, welds and the like to provide the seal between the corresponding layers.

Referring again to FIG. 3, the nozzles 202 extend through portions of the manifold body 200. For instance, in the example shown in FIG. 3, the plurality of nozzles 202 are seated within the intermediate layer 214. The plurality of nozzles 202 are coupled with the intermediate layer with one or more mechanisms, including but not limited to, adhesives, interference fits, or the like to provide a sealed engagement between the nozzles 202 and the portions of the intermediate layer 214 surrounding the nozzles. The sealed engagement between the nozzles 202 and the intermediate layer 214 allows for the delivery of a solution from the supply manifold 300 through the plurality of nozzle lumens 308 as described herein.

As further shown in FIG. 3, the nozzles 202 extend through the solution return passages 310 formed in one or more of the interface seal 316 and the interface plate 216. The nozzles 202 are spaced from the walls of the solution return passages 310 to thereby provide a gap for the passage of solution such as solvents and gases through the solution return passage 310 and into the return manifold 302. Because the plurality of nozzles 202 are seated within the intermediate layer 214, the nozzles 202 extend through the larger solution return passages 310 without requiring any lateral support from either of the interface seal 316 or the interface plate 216. Instead, these features are recessed relative to the plurality of nozzles 202 to provide the solution return passages 310 and thereby facilitate fluid communication between the exterior of the receptacle washing fixture 102, for instance along the interface seal 316 and the solution outlet 222 as shown in FIG. 3. That is to say, the plurality of nozzles 202 positioned within the receptacle washing fixture 102 are a part of a fluid delivery path that extends from the solution inlet 220 to the solution outlet 222. For instance, the fluid delivery path is formed by the solution inlet 220 and continues on through the inlet channel 304 to the supply manifold 300. As previously described, the supply manifold 300 is in fluid communication with the nozzle lumens 308 of the nozzles 202. Fluid is delivered through the nozzle lumens 308 to the exterior of the nozzles 202, for instance while the plurality of nozzles 202 are seated within one or more corresponding sockets of a connector coupled with the receptacle washing fixture 102. As previously described, the interface seal 316 provides a sealed engagement with the connector coupled with the receptacle washing fixture 102 and thereby allows the fluid delivery path to continue through the receptacle washing fixture 102 as the fluid is thereafter moved through the solution return passages 310 and into the return manifold 302. The solution or gas is then moved through the outlet channel 306 and eventually into the solution outlet 222 for eventual delivery to the solution recovery reservoir 110 previously shown in FIG. 1. As previously described, in one example, the receptacle washing fixture 102 is coupled with a source of negative pressure through the solution outlet to draw (as opposed to pressurizing) fluids through the fixture.

Figure 4:
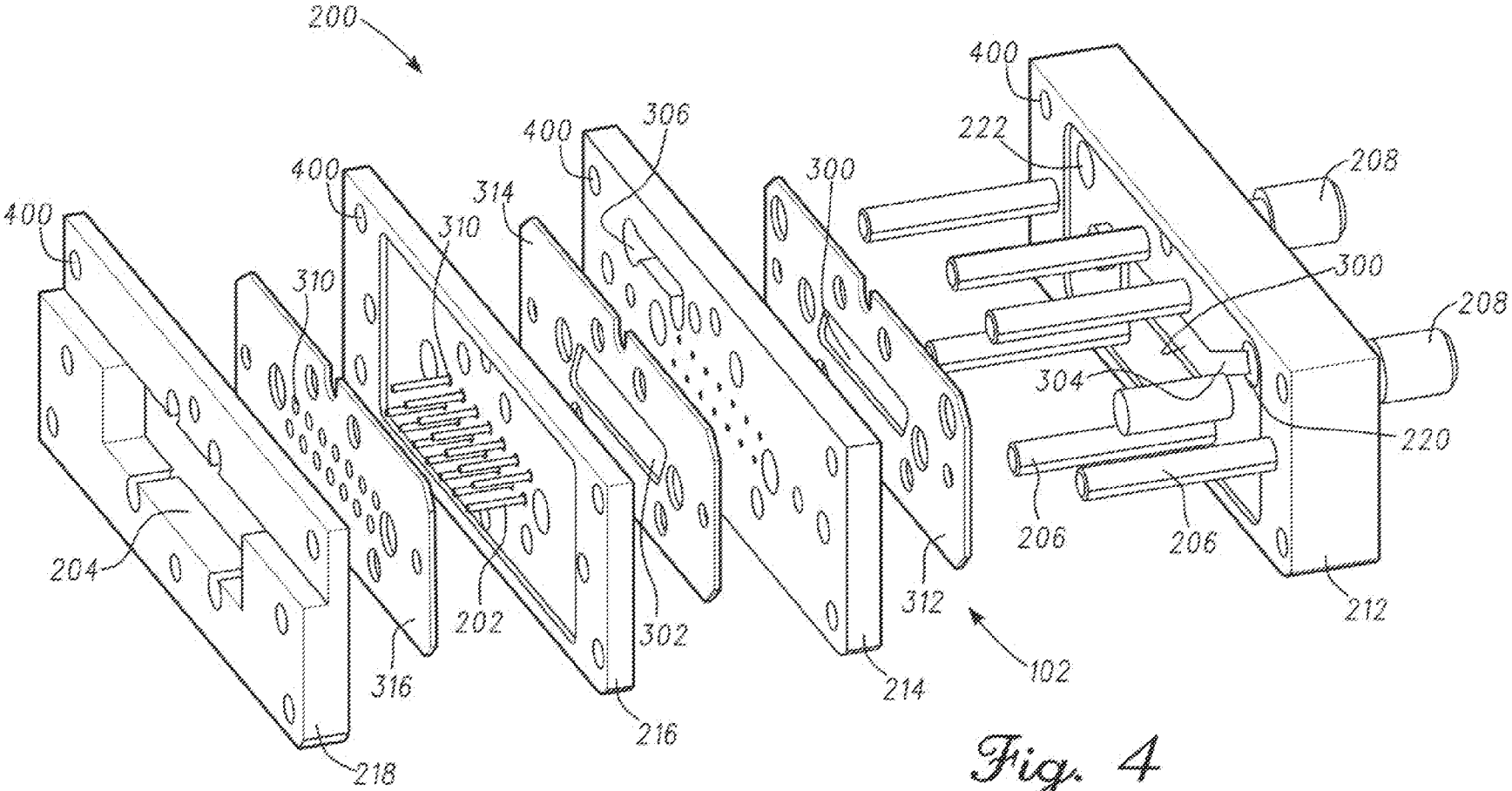
FIG. 4 is an exploded view of the receptacle washing fixture of FIG. 2A.

FIG. 4 shows an exploded view of the receptacle washing fixture 102 previously shown in FIGS. 1, 2A, and 2B. In the example shown, the manifold body 200 is formed with one or more layers, such as the base layer 212, the intermediate layer 214, and the interface plate 216. As shown in FIG. 4, an optional connector shroud 218 is provided to at least partially cover a connector coupled with the manifold body 200. The fluid delivery path previously described herein is shown in the exploded view according to the various features described and shown, for instance in FIG. 3. For instance, the fluid delivery path begins at the solution inlet 220 and proceeds to the inlet channel 304 shown in the base layer 212 of FIG. 4. The supply manifold 300 is shown as a recessed portion formed in the base layer 212. The supply manifold gasket 312 is further provided and includes a portion of the supply manifold 300 formed by a recess or cavity disposed therein. As previously discussed above, the plurality of nozzles 202 extend through the solution return passages 310 and the interface plate 216 as shown in FIG. 3. In FIG. 4, the plurality of nozzles 202 are shown extending through the interface plate 216. With the nozzles 202 seated within the intermediate layer 214, the nozzles are correspondingly in fluid communication with the supply manifold 300 as previously discussed.

In another example, the coupling of the intermediate layer with the interface plate 216, for instance with a return manifold gasket 314 therebetween, forms the return manifold 302 as shown by the cavity provided in the return manifold gasket 314. The solution return passages 310 extending at least partially around each of the plurality of nozzles 202 extend through the interface plate 216 and the interface seal 316 as shown in FIG. 4. In one example, the interface seal 316 is seated over the interface plate 216 and sandwiched between the interface plate 216 and the connector shroud 218. As shown in FIG. 3, the solution return passages 310 formed through the interface seal 316 and interface plate 216 are defined by corresponding side walls of the seal 316 and plate 216 that are spaced away from the nozzles 202 to thereby allow for a gap between the nozzles 202 and these components that facilitates the delivery of solutions and gases from the nozzles 202 and into the solution return passages 310 and the return manifold 302.

As further shown in FIG. 4, the outlet channel 306 in communication with the return manifold 302 is formed as part of the intermediate layer 214. In one example, the outlet channel 306 (as well as the inlet channel 304) are formed by one or more of molding, machining, and the like of the corresponding layers of the manifold body 200. As shown, for instance, in FIG. 4, the outlet channel 306 is in one example machined out of the interface plate 214 and extends from the return manifold 302 to a periphery of the interface plate 216 aligned with the solution outlet 222 formed in the base layer 212.

Optionally, the alignment skirt 206, for instance formed by a plurality of pins as shown in FIG. 4, is used to align each of the layers of the laminate of the manifold body 200 to thereby ensure the accurate assembly of each of the layers shown in FIGS. 2A, 2B, and 3. For instance, the plurality of pins of the alignment skirt 206 are fed through corresponding lumens in each of the layers, such as the intermediate layer 214, the interface plate 216, and the connector shroud 218 to align the layers and ensure the supply and return manifolds 300, 302 as well as the nozzles 220 are properly aligned or sealed (in the case of the manifolds) within the manifold body 200. In another example, the alignment skirt 206 aligns the plurality of orifices the nozzles 202 extend through, for instance the orifices making up the solution return passages 310 in the interface seal 316 and the interface plate 216. The provision of the alignment skirt 206 thereby substantially prevents the lateral impingement or contact of the nozzles 202 (having a narrower diameter than the small diameter sockets at the connector) and correspondingly prevents the undesirable bending, warping, or the like of the nozzles 202 during assembly of the receptacle washing fixture 102. Stated another way, the alignment skirt 206 provides an alignment feature both during assembly of the receptacle washing fixture 102 and during coupling of the receptacle washing fixture 102 with a connector for a cleaning operation.

In one example, the manifold body 200 is constructed with but not limited to one or more materials including metals, polymers, composites, and the like. For instance, in one example, each of the layers, such as the base layer, intermediate layer and interface plate, 212, 214, 216 (as well as the optional connector shroud 218) are formed with a polymer such as Delrin, a registered trademark of E. I. Du Pont de Nemours and Company, Wilmington Del. In another example, one or more of the layers are constructed with but not limited to metals such as aluminum, stainless steel, or the like. The various channels, orifices, and the like formed in each of the layers are formed by, but not limited to, machining, molding, punching, and the like. In one example, one or more of the layers are constructed with one material such as aluminum while the other layers such as the intermediate layer 214 are constructed with a plastic. In still another example, the nozzles 202 are constructed with a metal such as stainless steel, aluminum, or the like. In yet another example, the plurality of layers of the manifold body 200 are coupled together with one or more body fasteners such as the body fasteners 210 shown in FIG. 2A. In one example, the body fasteners 210 are threaded through the body fastener holes 400 shown in each of the layers in FIG. 4. The body fasteners 210 engage with corresponding threading or nuts of the manifold body 200 to thereby compress each of the respective layers 212, 218 together and thereby correspondingly seal the respective supply manifold 300 and return manifold 302, for instance by sandwiching of the respective supply and return manifold gaskets 312, 314 therebetween.

Figure 5A:
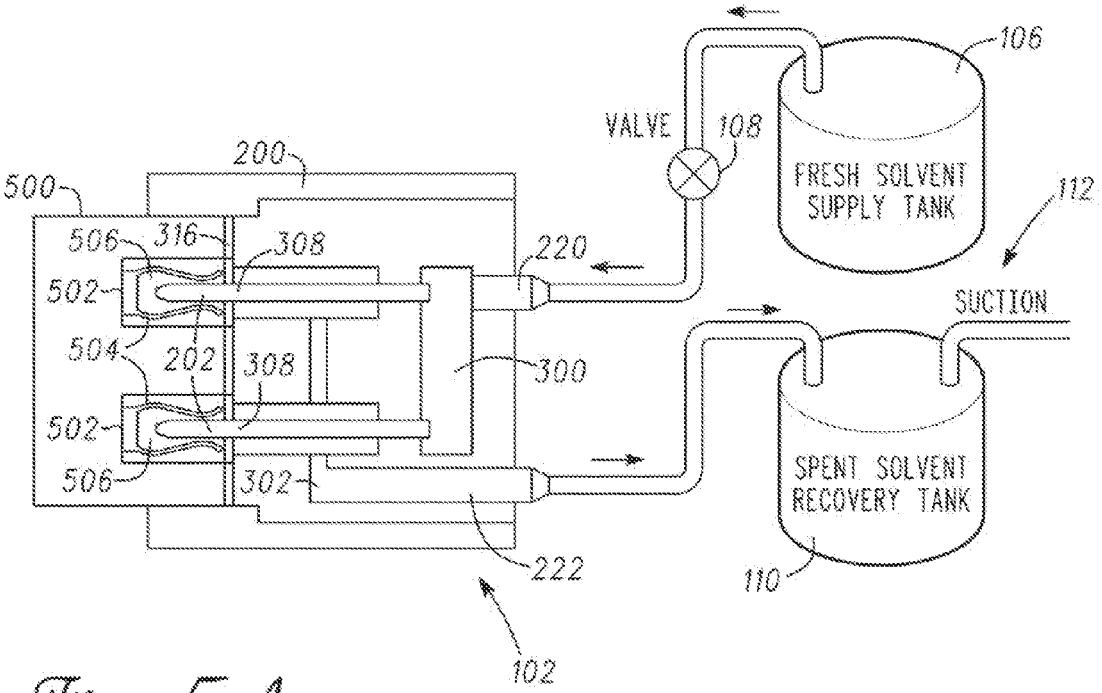
FIG. 5A is a schematic cross sectional view of the receptacle washing fixture of FIG. 2A coupled with a connector having female receptacles.
Figure 5B:
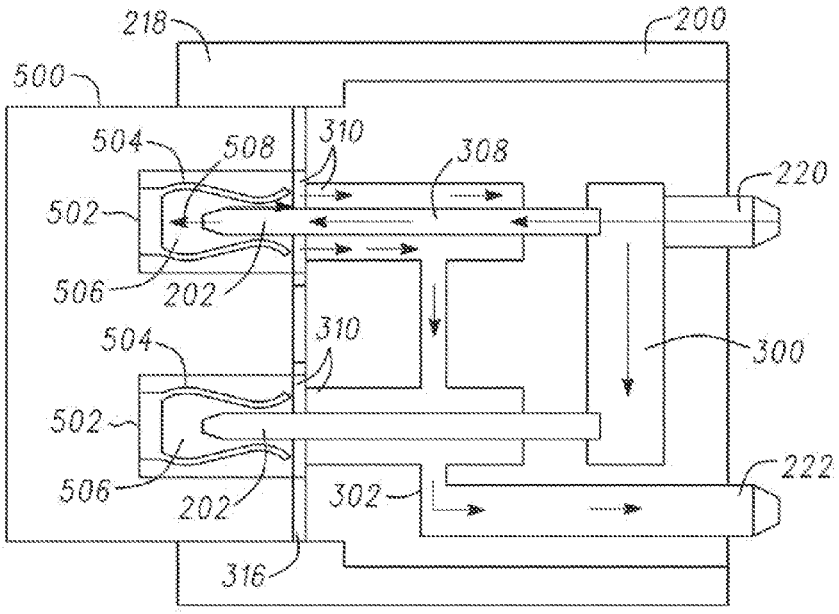
FIG. 5B is a detailed schematic view of a plurality of nozzles of the receptacle washing fixture including fluid flow into the and out of the connector.

FIGS. 5A and 5B show one example of the receptacle washing fixture 102 in a schematic perspective. As shown, the receptacle washing fixture 102 is coupled with a receptacle connector, such as a female connector 500 shown in FIG. 5A. The nozzles 202 including the nozzle lumens 308 therein are positioned within sockets 502 of the connector 500. As shown in the example in FIG. 5A, the connector 500 includes a plurality of sockets 502 (two are shown in this schematic view). Each of the sockets 502 in one example include corresponding socket contacts 504 having socket orifices 506 therein. In normal use, the connector 500, for instance a female connector is coupled with a corresponding male connector to thereby electrically connect the socket contacts 504 with corresponding pin contacts of the male connector. In the example shown in FIGS. 5A and 5B, the plurality of nozzles 902 are received in the same sockets 502 that normally receive the corresponding pins of the male connector. As shown in FIG. 5A and best shown in FIG. 5B, the plurality of nozzles 202 have a diameter smaller than the inner diameter of the socket contacts 504. As will be described in further detail below, the gap between the plurality of nozzles 202 and socket contacts of the sockets 502 allows for the inflow and outflow of fluids along the socket contacts for cleaning (and drying) through the nozzle lumens 208 and the solution return passages 310.

As further shown in FIG. 5A, the receptacle washing fixture 102 is coupled with a solution supply reservoir 106 and a solution recovery reservoir 110. As previously described, in one example the solution recovery reservoir 110 includes a vacuum source 112 such as a mechanical pump, hand pump, or the like providing a source of vacuum through the receptacle washing fixture 102. As further shown in the example in FIG. 5A, a control valve 108 is interposed between the solution supply reservoir 106 and the receptacle washing fixture 102. The control valve 108 is provided inline between the solution supply reservoir 106 and the vacuum source 112 to correspondingly allow and prevent the flow of fluid (cleaning solutions, gases including air and the like) between the valve 108, the receptacle washing fixture 102, and the solution recovery reservoir 110. Stated another way, the operation of the control valve 108 correspondingly controls the flow of fluids such as a solvent solution, air, and the like through the receptacle washing fixture 102 according to suction provided by the vacuum source 112.

Referring now to FIG. 5B, a detailed schematic view of the receptacle washing fixture 102 coupled with the receptacle connector 500 in FIG. 5A is provided. As previously described, the receptacle washing fixture 102 is coupled with the receptacle connector 500 with the plurality of nozzles 202 received in corresponding sockets 502. As shown in the example in FIG. 5B, each of the sockets 502 in this example receives a respective nozzle 202 of the plurality of nozzles. As further shown in FIG. 5B, the optional connector shroud 218 extends around at least a portion of the receptacle connector 500. As previously described, the connector shroud 218 assists in the reception of the receptacle connector 500 within the connector recess 204 of the receptacle washer fixture 102. In another example, the connector shroud 218 substantially prevents mechanical damage to the nozzles. In most applications, with the fluids (such as solvents, gasses and the like) delivered through the receptacle washing fixture 102 according to a negative pressure leaks between the interface of the receptacle connector 500 and the receptacle washing fixture 102 are substantially prevented. The connector shroud 218 is accordingly provided as a redundant cover to interrupt the flow or spray of any incidentally released fluids.

Referring again to FIG. 5B, the receptacle connector 500 is shown engaged along the interface seal 316 of the receptacle washing fixture 102. The engagement of the receptacle connector 500 along the interface seal 316 provides a sealed engagement of the receptacle connector with the receptacle washing fixture 102. As shown, the female connector 500 and the interface seal 316 (of the receptacle washing fixture 102) cooperate to form individual inflow and outflow paths 508 for each of the sockets 502 (e.g., part of the flow path through the fixture 102). As described herein, the provision of individual inflow and outflow paths 508 provides for individual cleaning of each of the sockets 502 and thereby substantially ensures removal of debris such as solder flux from each of the sockets 502. Each of the corresponding socket contacts 504 within each of the sockets 502 are thereby correspondingly cleaned to ensure optimal operation of the female connector 500 (e.g., optimal electrical connections through the female connector 500). Stated another way the individual inflow and outflow paths 508 formed by the combination of the nozzles 202, the sockets 502, the solution return passages 310, as well as the engagement of the receptacle connector 500 with the interface seal 316 provides for sealed interfaces between the receptacle connector 500 and the receptacle washing fixture 102 and inflow and outflow paths 508 for each of the sockets 502.

As shown with one example in FIG. 5B, the top most socket 502 includes a cyclical path through the nozzle 202 and into the socket 502 along the socket contacts 504 followed by removal of the solution such as a solvent, air or the like from the socket 502 through the solution return passage 310. The individual application of cleaning solutions as well as drying such as by air, gasses and the like to each of the sockets 502 provides for rapid and reliable cleaning of each of the sockets 502 and the corresponding socket contacts 504. The cleaning of the individual sockets separately substantially prevents the possibility of one or more of the sockets 502 not being cleaned with the receptacle washing fixture 101. Stated another way, by individually cleaning each of the sockets 502, for instance with a dedicated flow of cleaning solution to each of the sockets 502, the female connector 500 is reliably cleaned along each of the socket contacts 504 to ensure the optimum electrical operation of the female connector 500 (e.g., for power transmission, data transmission and the like).

At the return of the solvent solution to the return manifold 302 the suction supplied through the solution outlet 222 removes the solution, for instance, to the solution recovery reservoir 110 shown in FIG. 1 and FIG. 5A. As shown, the receptacle washing fixture 102 when coupled with the receptacle connector 500 provides one or more sealed inflow and outflow paths and distribution of a cleaning solution through the supply manifold 300 and recovery of the solution through the return manifold 302, for instance, through the plurality of nozzles 202 and the corresponding solution return passages 310. Additionally, by coupling the receptacle washing fixture 102 with the female connector 500 in a manner corresponding to a male connector coupled with the female connector 500 removal of the female connector is not required for thorough cleaning of each of the sockets 502. Instead, the receptacle washing fixture 102 is coupled with the female connector 500 as it is installed, for instance, in a piece of equipment. Because the receptacle washing fixture 102 has a size and shape substantially similar to that of a male connector coupled with the female connector 500 enlarged access (facilitated by the removal of surrounding components) or removal of the receptacle connector 500 is not required to clean the sockets 502. Additionally, because the cleaning solution, such as solvent, is delivered to the female connector 500 including the sockets 502 and socket contacts 504 therein under a negative pressure the cleaning solution is delivered in the cyclical paths shown in FIG. 5B. The solution is not delivered under pressure to the receptacle connector 500 and egress of the fluid, for instance between the interface of the interface seal 316 and the receptacle connector 500, is substantially prevented. Similarly, undesirable delivery of the cleaning solution, for instance by spraying into sensitive electronic components surrounding the installed receptacle connector 500, is substantially prevented.

Additionally, even where a leak exists between the receptacle connector 500 and the interface plate 216 (interface seal 316) shown in FIG. 5B because the receptacle cleaning assembly 100 including the receptacle washing fixture 102 is operated with a negative pressure, instead of the egress of solution, ambient atmosphere is drawn through the leak into the solution outlet 222. Additionally, the drawing of air into the solution outlet 222 through a leak likely creates air bubbles within the solution recovery reservoir 110 and notifies the operator that a leak may be present between the receptacle washing fixture 102 and the receptacle connector 500. The operator may then either more tightly couple the receptacle washing fixture 102 with the receptacle connector 500 or replace one or both of the receptacle connector 500 or the receptacle washing fixture 102.

Figure 6A:
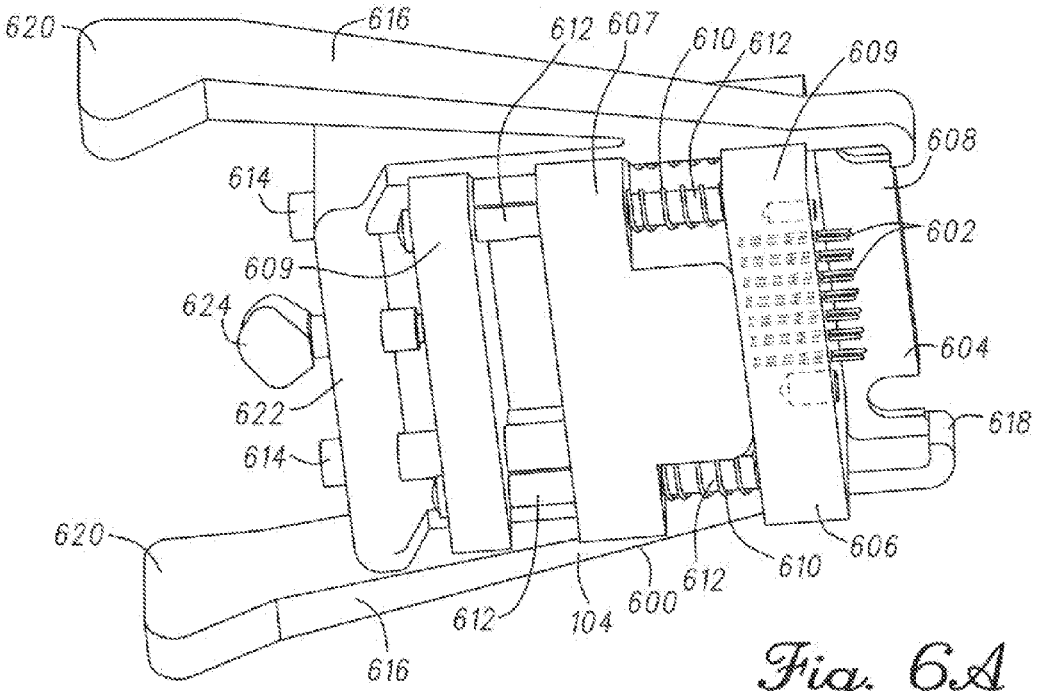
FIG. 6A is an isometric view of one example of a receptacle brush fixture with brushes deployed.

FIG. 6A shows another example of a cleaning fixture for use with the receptacle cleaning assembly 100 (see the kit shown in FIG. 1). The receptacle brush fixture 104 shown in FIGS. 6A, B is an optional portion of the receptacle cleaning assembly 100. The receptacle brush fixture 104 includes a brush fixture body 600 having a plurality of brushes 602 coupled with the brush fixture body 600 as described herein. In the example shown in FIG. 6A, the receptacle brush fixture 104 includes a plunger 607 movably coupled relative to the brush fixture body 600. The brushes 602 include brush heads and brush shafts 606. As shown, the brush shafts 606 extend from the plunger 607, and as will be described in further detail below, the brush shafts and brush heads 606, 604 are slidably coupled within brush cylinder 626 (see FIG. 6B).

In another example, the brush fixture body 600 includes an alignment skirt 608 including for instance, a ridge extending around at least a portion of the brush fixture body 600, as shown in phantom lines in FIG. 6A. In another example, the alignment skirt 608 includes one or more pins, for instance like the alignment skirt 206 shown in FIGS. 2A and 2B for the receptacle washing fixture 102. The alignment skirt 608 assists with aligning the plurality of brushes 602 with one or more receptacles, such as the sockets 502 of the connector 500 shown in FIGS. 5A and 5B. The alignment skirt, in another example, acts as one side, face or portion of a clamp (along with the jaws 618 described below as the other side of the clamp) for engagement with a female connector, such as connector 500.

As will be described in detail herein, the receptacle brush fixture 104 is in one example used with the female connector 500 shown in FIGS. 5A and 5B to mechanically engage with the socket contacts 504 and mechanically abrade and remove debris from the socket contacts 504. The combination of the brush fixture body 600 and the plunger 607 presenting the brushes 602 allows for reciprocal movement of each of the brushes 602 at the same time within the sockets 502. The brushes 602 are thereby able to quickly and readily remove debris from each of the sockets 502 and correspondingly restore optimal contact between each of the sockets 502 and the corresponding male pins of a male connector.

Referring again to FIG. 6A, in one example, the receptacle brush fixture 104 includes one or more biasing elements 610, such as compression springs, coupled between the plunger 607 and the alignment skirt 608. In one example, the biasing element 610 includes coil springs coupled in compression between the plunger 607 and a portion of the brush fixture body 600, for instance, a portion of the alignment skirt 608 including the brush cylinders 626 (further described and shown in FIG. 6B) therein. As shown in FIG. 6A, in one example, the biasing elements 610 are wrapped around guide posts 612 extending between a plunger stop 622 and the alignment skirt 608. The guide post 612 provide members or rails sized and shaped to receive the biasing element 610 thereon and substantially prevent the lateral movement of the biasing element 610 (e.g., buckling) during deflection including compression of the biasing element 610 during reciprocal operation of the plunger 607 to move the plurality of brushes 602 into and out of corresponding sockets of the female connector. In the example shown in FIGS. 6A, B, together the plunger stop 622, the alignment skirt 608 and the guide posts 612 form a plunger housing 609 that brackets the movement of the plunger 607 and at the same time facilitates movement of the alignment skirt 612 toward opposing jaws to clamp a connector to the fixture 104.

As further shown, the plunger 607 provided in FIG. 6A includes one or more plunger rods 614 extending through corresponding portions of the brush fixture body 600 and the plunger housing 609. The plunger rods 614 allow for the easy operation of the plunger 607 by the user. For instance, the plunger rods 614 allow for pushing of the plunger 607 from both sides of the plunger to thereby substantially prevent binding of the plunger 607 within the brush fixture body 600 during reciprocal movement. For instance, the plunger rods 614 substantially prevent the tilting of the plunger 607 along the guide posts 612 during proximal and distal movement of the plunger 607 to correspondingly retract and project the brushes 602 relative to the brush fixture body 600 and the alignment skirt 608. Additionally, the sliding engagement of the plunger rod 614, for instance, through orifices in the brush fixture body 600 as shown in FIG. 6A substantially prevents the lateral movement of the plunger 607 during reciprocation or during static positioning of the plunger 607, for instance, while engaged with the plunger stop 622 shown in FIG. 6B.

Referring again to FIG. 6A, in another example, the receptacle brush fixture 104 includes a retaining feature 616 sized and shaped to couple the receptacle brush fixture 104 with the corresponding receptacle connector such as the receptacle connector 500 shown in FIGS. 5A and 5B. In one example, the retaining feature includes but is not limited to a pair of jaws 618 operated by a jaw operator 620. As shown, the jaw operator 620 allows for deflection of the jaws 618 outwardly relative to the interior of the brush fixture body 600. As the brush fixture body 600 is slid into engagement with the receptacle connector 500 the opposing jaw 618 are deflected outward through inward biasing movement of the jaw operator 620 to allow for coupling of the receptacle connector 500 within the brush fixture body 600 (e.g., adjacent to the withdrawn brushes 602). After coupling of the receptacle connector with the alignment skirt of the receptacle brush fixture 104 the jaw operator 620 is relaxed and the jaws 618 are allowed to couple around the receptacle connector to thereby fix the receptacle brush fixture 104 to the receptacle connector 500.

Optionally, a thumb screw 624 coupled between the brush fixture body 600 and the plunger stop 622 (part of the plunger housing 609) is tightened to bias the plunger housing 609 toward the jaws 618 and tightly clamp the connector 500 between the alignment skirt 608 and the jaws. That is to say, the linear movement provided by turning of the thumb screw 624 (or other mechanism that moves the plunger housing 609) moves the plunger housing 609 toward the jaws 618 and clamps the connector therebetween. Because the plunger housing 609 is movable relative to the brush fixture body 600 the receptacle brush fixture 104 is usable with a variety of connectors having different lengths but the same pattern of sockets 502. Adjustment to the plunger housing 609 to move the alignment skirt 608 relative to the jaws 618 allows for clamping of the connectors with differing lengths.

After fixing the receptacle brush fixture 104 to the receptacle connector 500 reciprocal movement of the brushes 602, for instance, through proximal and distal movement of the plunger 607 is easily facilitated through operation of the plunger rods 614. In this orientation with the receptacle plunger 607 snuggly seated adjacent to the brush fixture body 600 (and optionally clamped through movement of the plunger housing 609 relative to the jaws 618) the brush heads 604 are aligned with the plurality of sockets of the receptacle connector according to the engagement of the jaws 618 with the receptacle connector. The plunger 607 is operated with the brushes 602 in close alignment to the pattern of sockets 502 of the receptacle connector 500 to reciprocate the brushes 602 into and out of the sockets 502.

Referring again to FIGS. 6A and 6B, as previously described the plunger 607 of the receptacle brush fixture 104 is configured for reciprocal movement relative to the brush fixture body 600 and the plunger housing 609 including the alignment skirt 608. As shown in FIG. 6A, the plurality of brushes 602 are presented in a projected configuration with the plunger 607 moved distally relative to the brush fixture body 600 and the alignment skirt 608. For instance, as shown, the plunger 607 is moved distally into engagement with the alignment skirt 608 of the plunger housing 609.

Figure 6B:
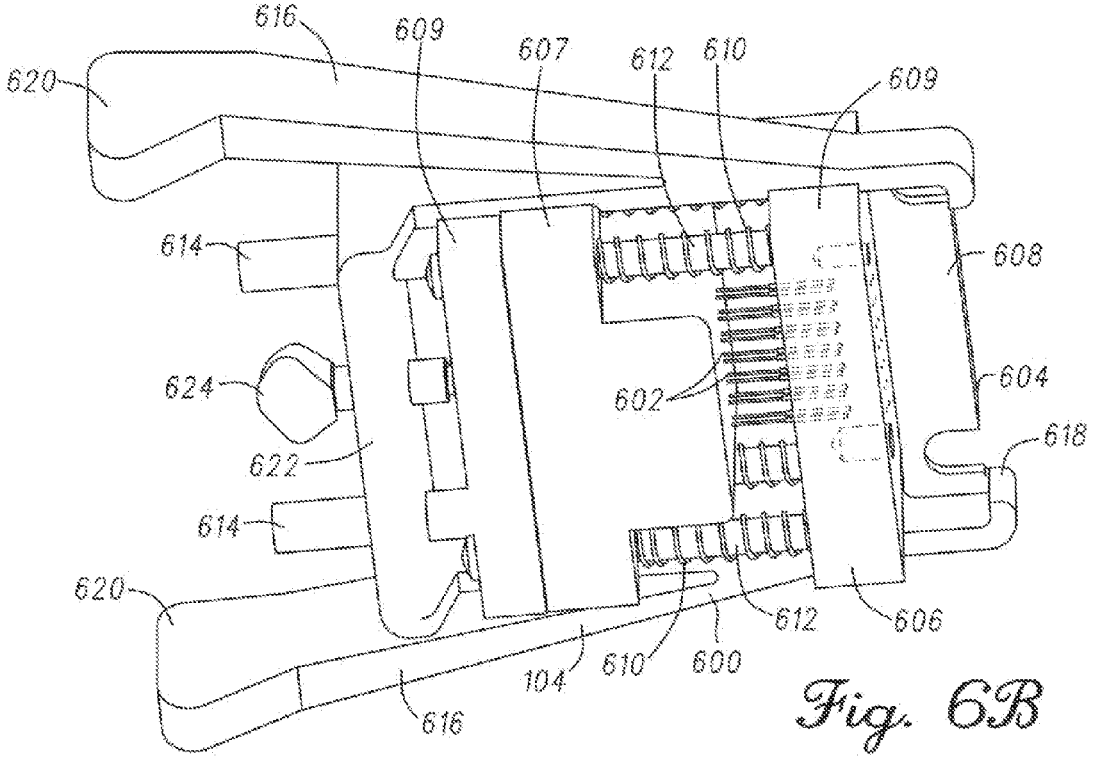
FIG. 6B is an isometric view of the receptacle brush fixture of FIG. 6A with the brushes retracted.

Referring now to FIG. 6B, the plunger 607 is shown withdrawn and engaged with the plunger stop 622 of the plunger housing 609. In this configuration, the plurality of brushes 602 are withdrawn into brush cylinders 626 sized and shaped to receive the brushes 602 therein. As shown in FIGS. 6A, B the brush cylinders 626 are formed in one example in the alignment skirt 608 of the plunger housing 609. The brush cylinders 626 house the brushes 602 in the withdrawn configuration and substantially prevent their misalignment and corresponding lateral deflection, for instance, caused by buckling of the plurality of the brushes 602 upon a misaligned engagement with a receptacle connector such as the receptacle connector 500. That is to say, with the brushes 602 withdrawn (as shown in FIG. 6B with the brush heads 604 withdrawn into the brush cylinders 626) the brush fixture body 600 and the plunger housing 609 are easily coupled with the receptacle connector and the jaws 618 ensure the receptacle connector is aligned with the brush cylinder 626. During the alignment process (e.g., coupling of the receptacle connector with the brush fixture body 600 and the plunger housing 609) the brushes 602 are retracted to substantially prevent engagement with the receptacle connector and deflection of the brushes 600 that could prevent aligned reception of the brushes 602 within the sockets 502 of the receptacle connector 500.

After coupling of the receptacle connector with the brush fixture body 600, for instance, through operation of the retaining features 616 including the jaws 618 and the alignment skirt 608 the sockets 502 of the receptacle connector 500 are aligned with the brush cylinders 626 and correspondingly aligned with the brushes 602. Operation of the plunger 607, for instance, through depression of the plunger rods 614 and through biasing caused by the biasing element 610 reciprocates the plunger 607 and the brushes 602 into and out of the sockets 502 to clean the socket contacts 504 as described below. The brushes 602 have a length corresponding to a proscribed depth of the connector sockets 502. For instance, in a deployed position (FIG. 6B), the brushes extend from the alignment skirt 608 and into the receptacles according to a desired length of the brush stroke (based on the brush length and plunger travel). The range of plunger 607 movement as well as the length of the brushes dictates the depth the brushes extend into the corresponding sockets 502.

Figure 7A:
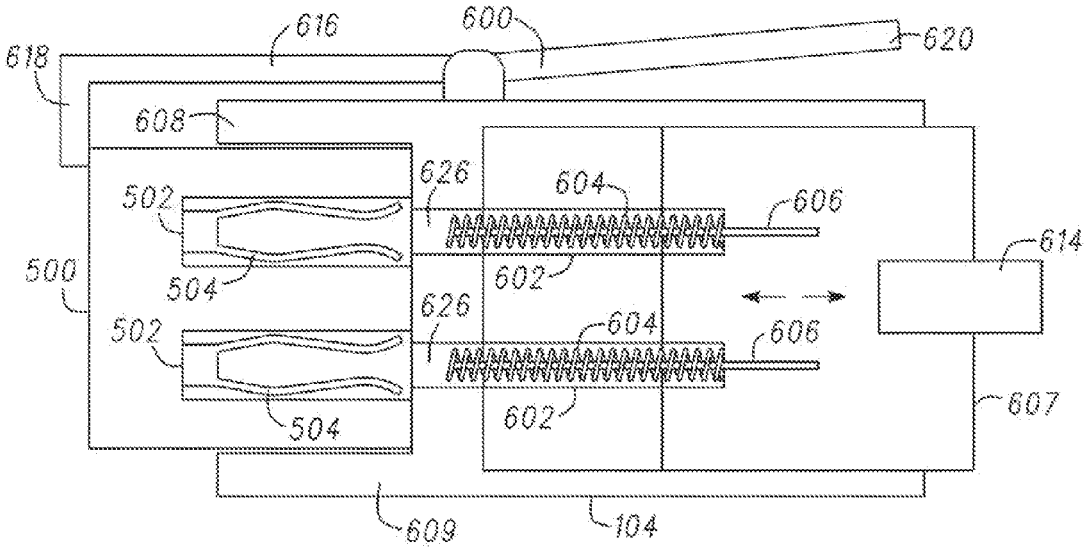
FIG. 7A is a cross sectional view of the receptacle brush fixture of FIG. 6A in a retracted position and coupled with a connector having female receptacles.
Figure 7B:
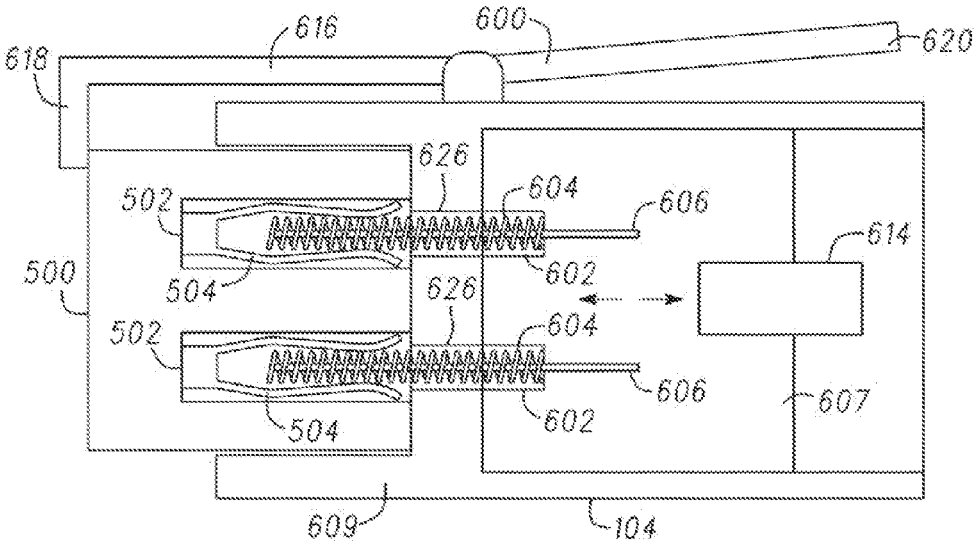
FIG. 7B is a cross sectional view of the receptacle brush fixture of FIG. 7A in a deployed position.

Referring now to FIGS. 7A and 7B, the receptacle brush fixture 104 is shown coupled with a receptacle connector 500. The receptacle connector 500 includes a female connector having corresponding sockets 502 with socket contacts 504 therein. In one example, the socket contacts 504 are sized and shaped to engage with corresponding male pins of a complementary male connector to provide electrical connections between the female and male connectors. As shown, the receptacle connector 500 is positioned within the alignment skirt 608 of the plunger housing 609. As further shown, in one example, the retaining feature 616 as described in one example (optionally part of the brush fixture body 600), includes jaws is engaged with a portion of the receptacle connector 500 to thereby fix the receptacle connector 500 relative to the brush fixture body 600 and the plunger housing 609. In another example, the plunger housing 609 is moved toward the jaws 618, for instance with a thumb screw 624 or other moving mechanism, to clamp the connector 500 therebetween.

In the configuration shown in FIG. 7A, the plunger 607 is in a withdrawn configuration with the plurality of brushes 602 withdrawn into the brush cylinders 626. In the example shown, the brush cylinders 626 are formed in part of the alignment skirt 608. In other examples the brush cylinders 626 are formed as part of the brush fixture body 600 or another portion of the plunger housing 609. The brushes 602 are withdrawn into the brush cylinders 626 while the receptacle connector 500 is aligned by the alignment skirt 608 (and optional movement of the plunger housing 609) during coupling of the receptacle connector 500 with the brush fixture body 600. After coupling of the receptacle connector 500 the connector is ready for cleaning with the reciprocation of the plunger 607.

Referring first to FIG. 7A and then 7B, the plunger 607 is reciprocated from the position shown in FIG. 7A (for instance, depressed) to move the brushes such as the brush head 604 out of the brush cylinders 626 and into the sockets 502 of the receptacle connector 500. The brush heads 604 are sized and shaped to have a diameter slightly larger than the inner diameter of the socket contacts 504. The brush heads 604 mechanically engage with the socket contacts 504 and thereby mechanically abrade and remove debris lodged along the socket contacts 504. The withdrawal of the brushes 602 from the sockets 502 correspondingly removes the debris with the brushes and thereby cleans the interior of the sockets 502 to substantially restore optimal contact of the socket contacts 504 with corresponding male pins of a male connector. In one example, the plunger 607 is reciprocated multiple times between the configuration shown in FIGS. 7A and 7B to provide multiple opportunities to engage and abrade debris along the socket contacts 504 and thereby provide a clean set of contacts. As previously described, the reciprocation of the plurality of brushes 602 within the sockets 502 provides a rapid and consolidated cleaning of each of the sockets 502 without requiring individual cleaning of each of the sockets. The receptacle connector 500 including all of its sockets 502 is thereby rapidly cleaned and provides optimal electrical contact between the sockets 502 and each of the mating male contacts positioned within the sockets 502.

The mechanical abrasion provided by the plurality of brushes 602 is performed without the application of any cleaning solutions such as solvents, in one example. That is to say, the receptacle brush fixture 104 is optionally operated on its own without the receptacle washing fixture 102. The receptacle connector 500 is thereby cleaned solely with the mechanical abrasion provided by the receptacle brush fixture 104. In still another example, the receptacle brush fixture 104 is used in combination with the receptacle washing figures 102 as described herein.

FIG. 8 shows the receptacle cleaning assembly 100 in an assembled configuration with receptacle washing fixture 102 coupled in series with the solution supply reservoir 106 and the solution recovery reservoir 110. As shown, the solution supply reservoir 106 is coupled with the solution inlet 220 of the receptacle washing fixture 102 by way of tubing 804, 806 coupled between the valve 108 and the solution supply reservoir 106 as well as the valve 108 and the receptacle washing fixture 102. Similarly, the solution recovery reservoir 110 is coupled with the solution outlet 222 of the receptacle washing fixture 102 with tubing 810.

In the example shown in FIG. 1, the control value 108 shown is a three way valve. As shown, the control valve 108 allows flow into the receptacle washing fixture 102 through the solution inlet 220 from either of the solution supply reservoir 106 and a gas source 802. As shown, the gas source 802 is coupled with the control valve 108 by way of tubing 808. In one example, the control valve 108 includes, for instance, a filtered opening that allows for the ingress of ambient air from around the receptacle cleaning assembly 100 when the control valve 108 is actuated for instance by the controller 800 into a configuration where the control valve 108 provides an open path to the solution inlet 220 from the gas source 802. In another example, the gas source 802 includes a dedicated gas source, for instance a tank of ambient air, inert gas and the like.

As further shown in FIG. 8, in one example, a controller 800 such as a processor, software module or the like is coupled with one or more of the features of the receptacle cleaning assembly 100. For instance, the controller 800 is coupled with the control valve 108 and the vacuum source 112 such as a vacuum pump. In another example, the controller 800 is coupled with one or both of the control valve 108 and the vacuum source 112. In the configuration shown in FIG. 8, the controller 800 controls the operation of the control valve 108 as well as the vacuum source 112 to operate the receptacle cleaning assembly 100.

As previously discussed, in one example, the receptacle washing fixture 102 is coupled with the receptacle connector 500 shown again in FIG. 8. For instance, the plurality of nozzles 202 of the fixture are each received in corresponding sockets 502 of the receptacle connector 500. When cleaning of the receptacle connector 500 is desired the controller 800 primes the vacuum source 112, for instance, by operating a vacuum pump to thereby provide a negative pressure in the solution recovery reservoir 110 that correspondingly draws a negative pressure through the tubing the receptacle washing fixture 102 and the solution supply reservoir 106. The controller 800 thereafter operates the control valve 108 to selectively open the fluid passage from the solution supply reservoir 106 to the receptacle washing fixture 102.

With the vacuum source 112 applying a negative pressure and the control valve 108 open, the vacuum source 112 draws a solution such as a solvent solution in the solution supply reservoir 106 into the supply manifold 300 through the solution inlet 220. The negative pressure correspondingly draws the solution through the plurality nozzles 202 into the sockets 502. As shown, for instance, in FIGS. 5A and 5B the solution flows over the solution contacts 504 and washes the solution contacts. The used solution is delivered through the solution return passages 310 into the return manifold 302. The continued operation of the vacuum source 112 draws the solution within the return manifold 302 through the solution outlet 222 and into the solution recovery reservoir 110.

The vacuum source 112 is in one example operated continuously to draw a specified amount of solution such as solvent from the solution supply reservoir 106 through the receptacle washing fixture 102 where it is applied to the receptacle connector 500. In another example, the controller 800 controls one or more of the control valve 108 and the vacuum source 112 to cyclically deliver the solution from the solution supply reservoir 106 to the receptacle connector 500. For instance, the valve over a period of time, for instance 100 milliseconds, actuates between the closed and opened positions to correspondingly allow and interrupt the flow of solvent. The rapid application of the solvent in bursts according to the operation of the control valve 108 provides repeated applications of the solution to the solution contacts 504 and maximizes the removal of debris such as solder flux from the solution contacts 504. Optionally, the controller 800 includes one or more cleaning schemes that apply the solvent continuously, according to a pattern of application (e.g., burst of solution) and the like. In one example, the controller 800 cycles the application of solvent from 100 to 500 milliseconds with each burst in that span lasting around 5 milliseconds. In another example, the controller 800 cycles the application of solvent through the fixture 102 and the connector 500 according to a first scheme (e.g., in bursts having a first duration) and then cycles the application of solvent according to a second scheme (e.g., continuous, for a different time spans, with bursts having a second duration and the like.

After the receptacle connector 500 is cleaned, for instance by the application of the solution to the plurality of sockets 502, the controller 800 in another example operates the control valve 108 into a third configuration and opens the solution inlet 220 for fluid communication with the gas source 802. The vacuum source 112 is operated again and draws gas from the gas source 802 through the solution inlet 220 and into the plurality of sockets 502. The application of gas through the nozzles 202 correspondingly dries and removes any remaining solvent (and debris) within the sockets 502. In one example, after application of the gas from the gas source 802 the controller 800 operates one or more of the vacuum source 112 and the control valve 108 to again apply solution from the solution supply reservoir 106, for instance a solvent, through the solution inlet 220 and the nozzles 202 of the receptacle washing fixture 102 to the plurality of sockets 502 of the receptacle connector 500. The solvent is optionally applied to one or more schemes as described above.

After the reapplication of solvent, for instance, from the solution supply reservoir 106 to the receptacle connector 500, the controller 800 operates the control valve 108 to the third configuration to open the gas source 802 to the receptacle connector 500 through the plurality of nozzles 202. The vacuum source 112 draws the gas from the gas source 802 through the receptacle connector 500 and each of the sockets 502 are dried including the socket contacts 504 therein. The receptacle connector 500 is decoupled from the receptacle washing fixture 102 with clean sockets 502 including clean socket contacts 504. The passage of the gas from the gas source 802 through the receptacle connector 500 draws out the remaining solution (as well as any remaining debris) therein and deposits it within the solution recovery reservoir 110 shown in FIG. 8.

In another example, the cleaning assembly 100 shown in FIG. 8 is used in combination with the receptacle brush fixture 104 shown in FIG. 1. For instance, the receptacle washing fixture 102 is first coupled with the receptacle connector 500 and an application of the solutions, such as a solvent, is applied as previously described. The receptacle connector 500 is thereafter disconnected from the receptacle washing fixture 102 to allow for coupling of the receptacle brush fixture 104 to the receptacle connector 500. As previously described and shown in FIG. 7A, 7B the plunger 607 of the receptacle brush fixture 104 is operated to reciprocate the brushes 602 within the sockets 502 of the receptacle connector 500. The mechanical engagement and abrasion provided by the brush heads 604 engaged with the socket contacts 500 mechanically removes debris such as solder flux on the socket contacts 504.

In another example, the receptacle brush fixture 104 is then removed and the receptacle washing fixture 102 is coupled with receptacle connector 500. The solution from the solution supply reservoir 106 is applied to the plurality of sockets 502 through the nozzles 202 to separately wash each of the sockets 502 according to the engagement of the receptacle connector 500 with the receptacle washing fixture 102, as previously described. After application of the solution, for instance from the solution supply reservoir 106, in one example, the controller 800 operates the control valve 108 to allow for the application of gas from the gas source 802 to the receptacle connector 500 through the solution inlet 220 and the nozzles 202 as previously described. The vacuum source 112 draws the gas through the receptacle connector 500 including the sockets 502 and removes any remaining solution therein and dries the sockets 502.

The combination of the mechanical abrasion provided by the receptacle brush fixture 104 and solution wash provided by the receptacle washing fixture 102 of the receptacle cleaning assembly 100 removes substantially any debris within the sockets 502 and thereby consistent provides reliable electrical contacts with the socket contacts 504 and the corresponding pins of a male connector coupled with the receptacle connector 500. In another example, the receptacle cleaning assembly 100 is operated without the receptacle brush fixture 104. For instance, the application of the solution such as the solvent by the receptacle washing fixture 102 from the solution supply reservoir 106 in combination with the application of gas from the gas source 802 by way of the controller 800 and the vacuum source 112 is able by itself to readily clean the receptacle connector 500. The receptacle cleaning assembly 100 including the receptacle washing fixture 102, the solution supply reservoir 106, and the solution recovery reservoir 110 are thereby able to substantially clean the receptacle connector 500 without mechanical abrasion being applied, for instance, with the receptacle brush fixture 104. Time consuming connection and disconnection of multiple fixtures is thereby avoided.

As previously described, the receptacle cleaning assembly 100, whether including the receptacle brush fixture 104 or not, is able to clean the receptacle connector 500 while the receptacle connector 500 is installed within a sensitive piece of equipment. With the receptacle brush fixture no pressure is applied to the receptacle connector 500, instead the brush is a reciprocated into and out of the sockets 502 of the receptacle connector to substantially abrade and remove any debris therein. In another example, with the receptacle washing fixture 102 the solution, for instance a solvent from the solution supply reservoir 106, is applied to the plurality of sockets 502 according to a negative pressure generated by the vacuum source 112. Any leaks between the receptacle connector 500 and the receptacle washing fixture 102 only draw air or surrounding gas into the receptacle connector 500 and into the fluid flow leading to the solution recovery reservoir 110. Because the solution from the solution supply reservoir 106 is not applied to the receptacle connector 500 under a positive pressure leaks including overspray of the solution outside of the receptacle connector 500 are substantially avoided. Sensitive surrounding equipment including electronics, reactive components and the like around the installed connector 500 are thereby protected during the cleaning of the receptacle connector 500 and are at substantially no risk for interaction with the solvents used. That is to say, the receptacle cleaning assembly 100 including one or both of the receptacle washing fixture 102 or the receptacle brush fixture 104 are configured to couple with the connector 500 in a similar manner to a corresponding male connector with pins. The fixtures 102, 104 are compact fittings that fit within surrounding equipment (cabinets, access panels and the like) in the same manner as the corresponding male connector. The fixtures 102, 104 of the receptacle cleaning assembly 100 is thereby usable within sensitive equipment having connectors 500 without requiring the removal or replacement of the connectors.

FIG. 9 shows one example of a method 900 for cleaning female receptacles such as sockets of a receptacle connector using, for instance, the receptacle cleaning assembly 100 previously shown in FIG. 1. In describing the method 900 reference is made to features and elements previously described herein including numbered references where convenient. Numbered elements provided within the description of the method 900 are not intended to be limiting. Instead, numbered references are provided for convenience and further include any similar features described herein as well as their equivalents.

At 902, the method 900 includes inserting a plurality of nozzles 202 within corresponding female receptacles of a connector. In one example, the female receptacles include the sockets 502 of the receptacle connector 500 shown in FIGS. 5A and 5B. The plurality of nozzles 202 are arranged on a manifold body 200 in a pattern corresponding to a pattern of the female receptacles. Stated another way, the plurality of nozzles are formed in a pattern corresponding to the pattern of the sockets 502 and closely match the corresponding pattern of pins on a complementary male connector sized and shaped for coupling with the female sockets of the connector 500.

At 904, a solution is delivered through the plurality of nozzles 202 and into the corresponding female receptacles, such as the sockets 502. As shown for example in FIG. 5B, the solution (such as a solvent) is delivered through the nozzle lumen 308 into each of the sockets 502 according to a negative pressure generated through the receptacle washing fixture 102 as shown in FIG. 5B. Optionally, the solution is applied by way of a positive pressure generator, for instance, at the solution supply reservoir 106. As shown in FIG. 5A, the solution is supplied from a solution supply reservoir 106 coupled with a solution inlet 220 at the receptacle washing fixture 102. At 906, the method 900 includes washing the solution along walls of the female receptacles (e.g., sockets 502 shown in FIG. 5B). As previously described, in one example the sockets 502 include socket contacts 504. The inflow and outflow path 508 created by the introduction of solution through the plurality of nozzles 202 into each of the sockets 502 according to the sealed engagement of the receptacle connector 500 and the washing fixture 102 applies the solution in a cyclical path 508 along the socket contacts 504 to wash the socket contacts, for instance, by hydrodynamic engagement and dissolving of debris lodged along the contacts 504.

At 908, the solution is extracted through at least one solution return passage 310 in the manifold body 200. As shown for instance in FIG. 5B and previously described herein, the coupling of the receptacle connector 500 with the receptacle washing fixture 102, for instance along the interface seal 316 of the interface plate 216 (see FIG. 3), provides a sealed environment for each of the sockets 502. The solution introduced to each of the sockets 502 is delivered in a circular path through the sockets 502 according to the introduction at the nozzles 202 and subsequent removal of the solution through the solution return passages 310 extending through the interface seal 316 and the interface plate 216 adjacent to each of the sockets 502. Each of the sockets 502 are individually cleaned with separate flows of solution along the corresponding inflow and outflow paths, 508 as shown in FIG. 5B.

Several options for the method 900 follow. In one example, delivering the solution includes delivering solution from the solution supply reservoir 106, as previously described herein, at a first pressure. Extracting the solution includes extracting the solution to a return reservoir, such as the solution return reservoir 110 shown in FIG. 5A at a second pressure less than the first pressure. For instance, as previously described, a vacuum source 112 is provided, in one example, with the solution return reservoir 110. The vacuum source 112 applies a negative pressure across the receptacle cleaning assembly 100 to draw the solution from the supply reservoir 106 therethrough. Stated another way the differential between the first and second pressures at the supply reservoir 106 and the solution recovery reservoir 110 is a negative pressure differential or a vacuum and thereby correspondingly draws the solution from the solution supply reservoir 106 through the receptacle washing fixture 102 and into the solution recovery reservoir 110. As previously described, drawing the solution through the receptacle washing fixture 102, for instance, by a negative pressure substantially prevents the egress or spraying of solution from the interface of the receptacle connector 500 and the receptacle washing fixture 102. The receptacle cleaning assembly 100 is thereby able to clean the receptacle connector 500 without allowing for the solution (e.g., a solvent or other cleaning solution) to be introduced to surrounding electronics, sensitive components and the like adjacent to the installed receptacle connector 500.

In another example, the method 900 includes drying the female receptacle, such as the sockets 502, of the receptacle connector 500 by drawing a gas through the plurality of nozzles 202 and the at least one solution return passage 310. For instance, in the example shown in FIG. 8 the control valve 108 is coupled with a gas source 802. Upon operation of the controller 800 or manual operation by an operator the control valve 108 is able to provide fluid communication between the gas source 802, the receptacle washing fixture 102 and the receptacle connector 500 coupled with the fixture 102. The vacuum source 102 correspondingly draws gas such as ambient air, inert gases and the like through the receptacle washing fixture 102 and into the sockets 502 of the receptacle connector 500 to dry the sockets 502, for instance.

In yet another example, delivering the solution includes delivering the solution through the plurality of nozzles 202 from a supply manifold 300 (shown in FIGS. 3, 5A and 5B) within the manifold body 200. In another example, extracting the solution through at least one solution return passage 310 in the manifold body 200 includes extracting the solution into a return manifold 302 as shown in FIGS. 3, 5A and 5B. The supply manifold, in one example, is coupled with the solution inlet 220 shown in FIG. 2B and the return manifold 302 is coupled with the solution outlet 222 also shown in FIG. 2B.

In still another example, the method 900 includes aligning the plurality of nozzles 202 with the female receptacles, such as the sockets 502 of a connector 500. In one example, aligning a plurality of nozzles include coupling an alignment skirt 206 with the receptacle connector 500 prior to insertion of the plurality of nozzles 202 into the sockets 502. For instance, as shown in FIG. 2A, in one example the alignment skirt 206 includes a plurality of alignment pins arranged around the connector recess 204. The receptacle connector 500 is guided by the alignment skirt 206 into close alignment with the plurality of nozzles 202 prior to delivery of the nozzles 202 into each of the sockets 502. The alignment skirt 206 substantially prevents the lateral deformation of the plurality of nozzles 202 and ensures the nozzles 202 are maintained in their substantially aligned configuration for coupling with multiple connectors over the lifetime of use of the receptacle washing fixture 102.

Optionally, the receptacle cleaning assembly 100 includes a receptacle brush fixture 104 as described herein. In such an example, the method 900 includes inserting a plurality of receptacle brushes such as the brushes 602 shown in FIGS. 6A and 6B within corresponding female receptacles or sockets 502 of the receptacle connector 500. The plurality of receptacle brushes 602 are arranged on a cleaning assembly body, such as a brush fixture body 600 or plunger housing 609, in a pattern corresponding to a pattern of the sockets 502. The method 900 further includes reciprocating the plurality of receptacle brushes 602 within the sockets 502 with a plunger 607 movably coupled with the brush fixture body 600 (e.g., the cleaning assembly body). Optionally, inserting the plurality of the receptacle brushes 602 and reciprocating the plurality of brushes is conducted at one or both of before or after insertion of the plurality of nozzles 202 of the receptacle washing fixture 102 within corresponding sockets 502 of the connector 500. Stated another way, the receptacle brush fixture 104 is, in one example, used in series with the same receptacle connector 500 to further clean the sockets 502 including, for instance, the socket contacts 504 in combination with the solution provided by the receptacle washing fixture 102. Additionally, the receptacle washing fixture 102 used in combination with the receptacle brush fixture 104 provides a solution flow of solvent or another solution to wash out any debris freed by the receptacle brushes 602 during reciprocation of the plunger 607 that is not otherwise removed by reciprocation or decoupling of the receptacle brush fixture 104 from the receptacle connector 500.

Various Notes & Examples

Example 1 can include subject matter, such as an apparatus, that can include a receptacle cleaning assembly comprising a receptacle washing fixture including a manifold body including a solution inlet and a solution outlet: a plurality of nozzles coupled with the manifold body and arranged in a pattern corresponding to a pattern of female receptacles of a connector, the plurality of nozzles are in communication with the solution inlet; an interface seal coupled with the manifold body, the plurality of nozzles extend through the interface seal, the interface seal is configured to seal along a face of the connector, at least one solution return passage extending through the interface seal from an exterior of the plurality of nozzles to the solution outlet; and an alignment skirt extending from the manifold body, the alignment skirt is sized and shaped to couple with the connector and align the plurality of nozzles with the female receptacles.

Example 2 can include, or can optionally be combined with the subject matter of Example 1, to optionally include a solution supply reservoir in communication with the solution inlet; and a solution recovery reservoir in communication with the solution outlet, wherein the solution recovery reservoir includes a vacuum source configured to draw solution through the solution inlet and the plurality of nozzles and through the at least one solution return passage and the solution outlet.

Example 3 can include, or can optionally be combined with the subject matter of one or any combination of Examples 1 or 2 to optionally include a receptacle brush fixture including a cleaning assembly body; a plunger movably coupled with the cleaning assembly body; a plurality of receptacle brushes coupled with the plunger and arranged in a pattern corresponding to a pattern of female receptacles of a connector; and a brush alignment skirt extending from the cleaning assembly body, the brush alignment skirt is sized and shaped to couple with the connector and align the plurality of receptacle brushes with the female receptacles.

Example 4 can include, or can optionally be combined with the subject matter of one or any combination of Examples 1-3 to optionally include wherein the manifold body includes an interface plate coupled with the interface seal, the plurality of nozzles extend through the interface plate; and the at least one solution return passage extends through the interface plate from an exterior of the plurality of nozzles; and wherein the manifold body includes a return manifold interposed between the interface plate and a remainder of the manifold body, and the return manifold is in communication with the at least one solution return passage and the solution outlet.

Example 5 can include, or can optionally be combined with the subject matter of one or any combination of Examples 1-4 to include wherein the at least one solution return passage includes a plurality of solution return passages, and each of the plurality of solution return passages is in communication with the return manifold.

Example 6 can include, or can optionally be combined with the subject matter of one or any combination of Examples 1-5 to include wherein the at least one solution return passage includes a plurality of solution return passages, and each of the solution return passages of the plurality of solution return passages extends through the interface seal adjacent to a nozzle of the plurality of nozzles.

Example 7 can include, or can optionally be combined with the subject matter of one or any combination of Examples 1-6 to include wherein when the interface seal is engaged with a connector the interface seal isolates each nozzle from the other nozzles of the plurality of nozzles, and solution delivered through each of the nozzles is correspondingly withdrawn through the solution return passage adjacent to each nozzle.

Example 8 can include, or can optionally be combined with the subject matter of one or any combination of Examples 1-7 to include wherein the manifold body includes a supply manifold in communication with the supply inlet and the plurality of nozzles.

Example 9 can include, or can optionally be combined with the subject matter of one or any combination of Examples 1-8 to include wherein the manifold body includes a return manifold in communication with the supply outlet and the at least one solution return passage.

Example 10 can include, or can optionally be combined with the subject matter of one or any combination of Examples 1-9 to include wherein the manifold body is a laminate including a base layer including the supply inlet and the supply outlet, an intermediate layer coupled with the base layer, the plurality of nozzles extend from the intermediate layer, and the supply manifold is interposed between the base and intermediate layers, and an interface plate coupled with the intermediate layer and the interface seal, the plurality of nozzles extend through the interface plate and the at least one solution return passage extends through the interface plate.

Example 11 can include, or can optionally be combined with the subject matter of one or any combination of Examples 1-10 to include a supply manifold gasket interposed between portions of the base layer and the intermediate layer; and a return manifold gasket interposed between the interface plate and the intermediate layer.

Example 12 can include, or can optionally be combined with the subject matter of one or any combination of Examples 1-11 to include wherein the at least one solution return passage includes a solution return passage associated with each of the plurality of nozzles, and the solution return passages and the plurality of nozzles are arranged to provide separate inflow and outflow paths to each socket of a receptacle connector positioned along the interface seal with the nozzles received in the respective sockets.

Example 13 can include, or can optionally be combined with the subject matter of one or any combination of Examples 1-12 to include a retaining feature coupled with the manifold body, the retaining feature is configured to fix a connector relative to the manifold body.

Example 14 can include, or can optionally be combined with the subject matter of one or any combination of Examples 1-13 to include wherein the retaining feature includes one or more thumbscrews configured for engagement with corresponding features of a connector.

Example 15 can include, or can optionally be combined with any portion or combination of any portions of any one or more of Examples 1-14 to include, subject matter, such as an apparatus, that can include a receptacle cleaning assembly comprising a receptacle brush fixture including a cleaning assembly body; a plunger movably coupled with the cleaning assembly body; a plurality of receptacle brushes coupled with the plunger and arranged in a pattern corresponding to a pattern of female receptacles of a connector, and an alignment skirt extending from the cleaning assembly body, the alignment skirt is sized and shaped to couple with the connector and align the plurality of receptacle brushes with the female receptacles.

Example 16 can include, or can optionally be combined with the subject matter of one or any combination of Examples 1-15 to include a receptacle washing fixture including a manifold body including a solution inlet and a solution outlet; a plurality of nozzles coupled with the manifold body and arranged in a pattern corresponding to a pattern of female receptacles of a connector, the plurality of nozzles are in communication with the solution inlet; an interface seal coupled with the manifold body, the plurality of nozzles extend through the interface seal, the interface seal is configured to seal along a face of the connector, at least one solution return passage extending through the interface seal from an exterior of the plurality of nozzles to the solution outlet; and a nozzle alignment skirt extending from the manifold body, the nozzle alignment skirt is sized and shaped to couple with the connector and align the plurality of nozzles with the female receptacles.

Example 17 can include, or can optionally be combined with the subject matter of one or any combination of Examples 1-16 to include a biasing element interposed between the cleaning assembly body and the plunger, and the biasing element biases the plunger away from the alignment skirt.

Example 18 can include, or can optionally be combined with the subject matter of one or any combination of Examples 1-17 to include wherein the cleaning assembly body includes a plurality of brush cylinders, each of the plurality of brushes is movably positioned within a corresponding brush cylinder of the plurality of brush cylinders, and the plunger positions the plurality of brushes between deployed and retracted positions in the deployed position the plunger is depressed and the plurality of brushes are correspondingly extended from a portion of the cleaning assembly body, and in the retracted position the plunger is raised and the plurality of brushes are at least partially withdrawn into the plurality of brush cylinders.

Example 19 can include, or can optionally be combined with the subject matter of one or any combination of Examples 1-18 to include wherein in the deployed position the plurality of brushes have a deployed length measured from the cleaning assembly body less than or equal to a length of female receptacles of a connector.

Example 20 can include, or can optionally be combined with the subject matter of one or any combination of Examples 1-19 to include wherein the cleaning assembly body includes one or more guide posts and the plunger is slidably coupled along the guide posts.

Example 21 can include, or can optionally be combined with the subject matter of one or any combination of Examples 1-20 to include a retaining feature coupled with the cleaning assembly body, the retaining feature is configured to fix a connector relative to the cleaning assembly body.

Example 22 can include, or can optionally be combined with the subject matter of one or any combination of Examples 1-21 to include wherein a first portion of the cleaning assembly body includes a plunger housing, the plunger is movably coupled with the plunger housing, and the plunger housing is movable relative to a second portion of the cleaning assembly body.

Example 23 can include, or can optionally be combined with the subject matter of one or any combination of Examples 1-22 to include wherein the second portion of the cleaning assembly body includes one or more jaws, and movement of the plunger housing toward the one or more jaws clamps a connector therebetween.

Example 24 can include, or can optionally be combined with any portion or combination of any one or more of Examples 1-23 to include, subject matter, such as a method, that can include a method of cleaning female receptacles of a connector comprising inserting a plurality of nozzles within corresponding female receptacles of a connector, the plurality of nozzles are arranged on a manifold body in a pattern corresponding to a pattern of the female receptacles; delivering a solution through the plurality of nozzles and into the corresponding female receptacles; washing the solution along walls of the female receptacles; and extracting the solution through at least one solution return passage in the manifold body.

Example 25 can include, or can optionally be combined with the subject matter of one or any combination of Examples 1-24 to include wherein delivering the solution includes delivering solution from a solution supply reservoir at a first pressure; and extracting the solution includes extracting the solution to a return reservoir at a second pressure less than the first pressure, and the solution is delivered according to a negative pressure differential between the first and second pressures.

Example 26 can include, or can optionally be combined with the subject matter of one or any combination of Examples 1-25 to include drying female receptacles of a connector including drawing a gas through the plurality of nozzles and the at least one solution return passage.

Example 27 can include, or can optionally be combined with the subject matter of one or any combination of Examples 1-26 to include wherein delivering the solution includes delivering the solution through the plurality of nozzles from a supply manifold within the manifold body.

Example 28 can include, or can optionally be combined with the subject matter of one or any combination of Examples 1-27 to include wherein the at least one solution return passage includes a plurality of solution return passages, and one or more of the solution return passages are adjacent to one or more nozzles of the plurality of nozzles, respectively, and extracting the solution includes extracting the solution through the plurality of solution return passages.

Example 29 can include, or can optionally be combined with the subject matter of one or any combination of Examples 1-28 to include engaging an interface seal with a connector including female receptacles; sealing each of the female receptacles through the interface seal engagement; and washing the solution along the walls of the female receptacles is conducted in the sealed female receptacles.

Example 30 can include, or can optionally be combined with the subject matter of one or any combination of Examples 1-29 to include aligning the plurality of nozzles with female receptacles of a connector, wherein aligning the plurality of nozzles includes coupling an alignment skirt with the connector before inserting the plurality of nozzles.

Example 31 can include, or can optionally be combined with the subject matter of one or any combination of Examples 1-30 to include inserting a plurality of receptacle brushes within corresponding female receptacles of a connector, the plurality of receptacle brushes are arranged on a cleaning assembly body in a pattern corresponding to a pattern of the female receptacles; and reciprocating the plurality of receptacle brushes within the female receptacles with a plunger movably coupled with the cleaning assembly body.

Example 32 can include, or can optionally be combined with the subject matter of one or any combination of Examples 1-31 to include wherein inserting the plurality of receptacle brushes and reciprocating the plurality of receptacle brushes is conducted at one or both of before or after inserting the plurality of nozzles within corresponding female receptacles of a connector.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A receptacle cleaning assembly comprising:

a receptacle washing fixture including:

a manifold body including a solution inlet and a solution outlet, and the manifold body includes a plurality of stacked layers including an interface plate, an intermediate layer and a base layer;

a plurality of nozzles coupled with the manifold body and arranged in a pattern corresponding to a pattern of female receptacles of a connector, the plurality of nozzles are in communication with the solution inlet;

an interface seal extending across and coupled with the interface plate, the plurality of nozzles extend through the interface seal, the interface seal is configured to seal along a face of the connector;

a plurality of solution return passages extending through the interface seal from an exterior of the plurality of nozzles to the solution outlet, each of the plurality of nozzles extends through a respective solution return passage of the plurality of solution return passages;

a return manifold in communication with each of the plurality of solution return passages and the solution outlet, the return manifold in the intermediate layer and between the interface plate and the base layer; and an alignment skirt extending from the manifold body, the alignment skirt is sized and shaped to couple with the connector and align the plurality of nozzles with the female receptacles.

2. The receptacle cleaning assembly of claim 1 comprising:

a solution supply reservoir in communication with the solution inlet; and a solution recovery reservoir in communication with the solution outlet, wherein the solution recovery reservoir includes a vacuum source configured to draw solution through the solution inlet and the plurality of nozzles and through the plurality of solution return passages and the solution outlet.

3. The receptacle cleaning assembly of claim 1 comprising a receptacle brush fixture including:

a cleaning assembly body;

a plunger movably coupled with the cleaning assembly body;

a plurality of receptacle brushes coupled with the plunger and arranged in a pattern corresponding to the pattern of female receptacles of the connector; and a brush alignment skirt extending from the cleaning assembly body, the brush alignment skirt is sized and shaped to couple with the connector and align the plurality of receptacle brushes with the female receptacles.

4. The receptacle cleaning assembly of claim 1 wherein the plurality of nozzles extend through the interface plate; and the plurality of solution return passages extend through the interface plate from an exterior of the plurality of nozzles.

5. The receptacle cleaning assembly of claim 1, wherein when the interface seal is engaged with a connector the interface seal isolates each nozzle from the other nozzles of the plurality of nozzles, and solution delivered through each of the nozzles is correspondingly withdrawn through the solution return passage each nozzle extends through, respectively.

6. The receptacle cleaning assembly of claim 1, wherein the manifold body includes a supply manifold in communication with the supply inlet and the plurality of nozzles.

7. The receptacle cleaning assembly of claim 6, wherein the manifold body is a laminate including:

the base layer including the supply inlet and the supply outlet, the intermediate layer coupled with the base layer; the plurality of nozzles extend from the intermediate layer, and the supply manifold is interposed between the base and intermediate layers, and the interface plate is coupled with the intermediate layer and the interface seal, the plurality of nozzles extend through the interface plate and the plurality of solution return passages extend through the interface plate.

8. The receptacle cleaning assembly of claim 7 comprising:

a supply manifold gasket interposed between portions of the base layer and the intermediate layer; and a return manifold gasket interposed between the interface plate and the intermediate layer.

9. The receptacle cleaning assembly of claim 1, wherein each solution return passage of the plurality of solution return passages and each nozzle of the plurality of nozzles are arranged to provide separate inflow and outflow paths to each socket of the connector positioned along the interface seal with the nozzles received in the respective sockets.

10. The receptacle cleaning assembly of claim 1 comprising a retaining feature coupled with the manifold body, the retaining feature is configured to fix the connector relative to the manifold body.

11. The receptacle cleaning assembly of claim 10, wherein the retaining feature includes one or more thumbscrews configured for engagement with corresponding features of the connector.

12. The receptacle cleaning assembly of claim 1, wherein each of the solution return passages surrounds a respective nozzle of the plurality of nozzles.

13. The receptacle cleaning assembly of claim 1, wherein the return manifold extends across the manifold body wherein each of the plurality of nozzles extends through the return manifold.

14. A receptacle cleaning assembly comprising:

a receptacle washing fixture including:

a manifold body including a solution inlet and a solution outlet, and the manifold body includes a plurality of stacked layers including an interface plate, an intermediate layer and a base layer;

a plurality of nozzles coupled with the manifold body and arranged in a pattern corresponding to a pattern of female receptacles of a connector, the plurality of nozzles are in communication with the solution inlet;

an interface seal extending across and coupled with the interface plate, the plurality of nozzles extend through the interface seal, the interface seal is configured to seal along a face of the connector;

a plurality of solution return passages extending through the interface seal from an exterior of the plurality of nozzles to the solution outlet;

a return manifold extending across the manifold body and in communication with each of the plurality of solution return passages and the solution outlet, the return manifold in the intermediate layer and between the interface plate and the base layer, wherein each of the plurality of nozzles extends through the return manifold; and an alignment skirt extending from the manifold body, the alignment skirt is sized and shaped to couple with the connector and align the plurality of nozzles with the female receptacles.

15. The receptacle cleaning assembly of claim 14, wherein each of the plurality of nozzles extends through a respective solution return passage of the plurality of solution return passages.

16. The receptacle cleaning assembly of claim 14, wherein each of the solution return passages surrounds a respective nozzle of the plurality of nozzles.

17. The receptacle cleaning assembly of claim 14 comprising:

a solution supply reservoir in communication with the solution inlet; and a solution recovery reservoir in communication with the solution outlet, wherein the solution recovery reservoir includes a vacuum source configured to draw solution through the solution inlet and the plurality of nozzles and through the plurality of solution return passages and the solution outlet.

18. The receptacle cleaning assembly of claim 14 comprising a receptacle brush fixture including:

a cleaning assembly body;

a plunger movably coupled with the cleaning assembly body;

a plurality of receptacle brushes coupled with the plunger and arranged in a pattern corresponding to a pattern of female receptacles of a connector; and a brush alignment skirt extending from the cleaning assembly body, the brush alignment sized and shaped to couple with the connector and align the plurality of receptacle brushes with the female receptacles.

19. The receptacle cleaning assembly of claim 14, wherein when the interface seal is engaged with a connector the interface seal isolates each nozzle from the other nozzles of the plurality of nozzles, and solution delivered through each of the nozzles is correspondingly withdrawn through a respective solution return passage of the plurality of adjacent to each nozzle.

20. The receptacle cleaning assembly of claim 14, wherein each solution return passage of the plurality of solution return passages and each nozzle of the plurality of nozzles are arranged to provide separate inflow and outflow paths to each socket of a receptacle connector positioned along the interface seal with the nozzles received in the respective sockets.

21. The receptacle cleaning assembly of claim 14 comprising a retaining feature coupled with the manifold body, the retaining feature is configured to fix a connector relative to the manifold body.

22. The receptacle cleaning assembly of claim 21, wherein the retaining feature includes one or more thumbscrews configured for engagement with corresponding features of a connector.

* * * * *